United States Patent [19]

Ichijima et al.

[11] Patent Number: 4,741,994

[45] Date of Patent: May 3, 1988

[54] SILVER HALIDE COLOR PHOTOGRAPHIC MATERIAL

[75] Inventors: Seiji Ichijima; Kohzaburoh Yamada; Hideo Usui, all of Kanagawa, Japan

[73] Assignee: Fuji Photo Film Co., Ltd., Japan

[21] Appl. No.: 782,832

[22] Filed: Oct. 2, 1985

[30] Foreign Application Priority Data

| | | | |
|---|---|---|---|
| Oct. 2, 1984 | [JP] | Japan | 59-206831 |
| Oct. 4, 1984 | [JP] | Japan | 59-208554 |
| Oct. 25, 1984 | [JP] | Japan | 59-224697 |

[51] Int. Cl.[4] ..... G03C 1/40; G03C 7/36; G03C 7/34

[52] U.S. Cl. ..... 430/549; 430/553; 430/555; 430/557; 430/558; 430/955; 430/957; 430/551

[58] Field of Search ..... 430/553, 555, 557, 558, 430/551, 957, 959, 226, 955, 214, 549

[56] References Cited

U.S. PATENT DOCUMENTS

| | | | |
|---|---|---|---|
| 4,248,962 | 2/1981 | Lau | 430/544 |
| 4,413,054 | 11/1983 | Mitsui et al. | 430/555 |
| 4,447,523 | 5/1984 | Ross et al. | 430/214 |
| 4,555,479 | 11/1985 | Sakai et al. | 430/555 |
| 4,556,630 | 12/1985 | Furutachi et al. | 430/555 |
| 4,584,264 | 4/1986 | Ohki et al. | 430/551 |
| 4,618,571 | 10/1986 | Ichijima et al. | 430/553 |
| 4,678,743 | 7/1987 | Yamada et al. | 430/551 |

*Primary Examiner*—Richard L. Schilling
*Attorney, Agent, or Firm*—Sughrue, Mion, Zinn, Macpeak, and Seas

[57] ABSTRACT

A silver halide color photographic material having improved granularity and sharpness is disclosed which comprises at least one coupler represented by formula (Ia), (Ib), or (Ic).

(Ia)

(Ib)

(Ic)

wherein A represents a coupler residue which can split away from the coupler by A—X bond cleavage upon reaction with an oxidation product of a developing agent; X represents an oxygen atom, or a sulfur atom; $R_1$ and $R_2$ each represents an aliphatic group, an aromatic group, or a heterocyclic group; Y represents a substituent group; and n represents 0, 1, or 2, and when n is 2, the two Y's represent the same or different substituent groups, or two of substituents $R_1$, $R_2$ and Y represent divalent groups that combine with each other to form a ring structure.

24 Claims, No Drawings

SILVER HALIDE COLOR PHOTOGRAPHIC MATERIAL

FIELD OF THE INVENTION

The present invention relates to a silver halide color photographic material comprising a photographic coupler for improving sharpness and granularity.

BACKGROUND OF THE INVENTION

It is well known that when a silver halide color photographic material is subjected to color development, couplers present therein undergo reaction with oxidized aromatic primary amine type color developing agents to produce indophenol dyes, indoaniline dyes, indamine dyes, azomethine dyes, phenoxazine dyes, phenazine dyes, or analogues thereof, whereby color images are formed. In this method, the subtractive color process is generally employed for color reproduction, and silver halide emulsions sensitized selectively to blue light, green light, and red light, respectively, and yellow-, magenta-, and cyan-dye-forming agents which bear a complementary color relationship to their corresponding emulsions are used in combination. In order to form a yellow dye image, couplers of, e.g., the acylacetoanilide type or the dibenzoylmethane type are employed. In order to form a magenta dye image, couplers of the pyrazolone, pyrazolobenzimidazole, cyanoacetophenone or indozolone type are generally used. In order to form a cyan dye image, phenolic couplers, e.g., phenols and naphthols, are generally used.

In recent years, it has acquired a greater importance than in the past to enhance image qualities of silver halide photographic materials, particularly those for taking color photographs, as disk cameras and 110-size cameras have been popularized. Especially, improvements in sharpness and granularity are of importance.

It is also well known that couplers can be employed not only for forming dye images, but also for the purpose of releasing photographically useful groups. On the other hand, various compounds capable of releasing photographically useful groups have been used for a wide variety of purposes, respectively, for instance, enhancement of color reproducibility, improvement in granularity, improvement in sharpness, increase in photographic speed, and so on.

Moreover, certain couplers which can release, from their coupling sites, compounds capable of capturing oxidation products of color developing agents have been described, for example, in Japanese Patent Applications (OPI) Nos. 28318/77, 111537/82 and 138636/82, and so on. In detail, Japanese Patent Application (OPI) No. 28318/77 discloses a coupler capable of releasing a so-called competing coupler residue upon reaction with an oxidation product of an aromatic primary amine developing agent. Japanese Patent Application (OPI) No. 111537/82 discloses a coupler illustrated by the following formula:

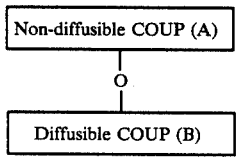

wherein Non-diffusible COUP (A) is a non-diffusible coupling component (A) bonding to the oxygen atom at the position at which a coupling reaction takes place with an oxidation product of a color developing agent to form a colored or colorless compound, and Diffusible COUP (B) is a diffusible coupling componet (B) bonding to Non-diffusible COUP (A) through the oxygen atom in such a manner that it is released upon the coupling reaction between Non-diffusible COUP (A) and the oxidation product and it also reacts with an oxidation product of the color developing agent as a 4-equivalent coupler to form a dye. Japanese Patent Application (OPI) No. 138636/82 discloses a coupler represented by COUP-ED, wherein COUP is a photographic coupler residue capable of forming a dye image by a reaction with an oxidation product of a color developing agent, and ED is a group bonding to the coupling site of COUP and being released from COUP to undergo an oxidation-reduction reaction with an oxidation product of a color developing agent. Such couplers, though employed with the intention of improving granularity or controlling the gradation, do not have much effect, so further improvement on such couplers has been desired. In addition, compounds released from these known couplers to capture oxidation products of developing agents have been found to have not only weak capturing power, but also little diffusibility. Accordingly, they cannot fully achieve the desired improvement in sharpness, and further, cannot produce the interimage effect due to diffusion into other layers.

SUMMARY OF THE INVENTION

Therefore, an object of the present invention is to provide a color photographic material which contains a novel coupler which releases compounds capable of capturing oxidation products of developing agents upon the reaction with the oxidation products of the developing agents, whereby improvements in granularity, sharpness, or color reproducibility through the interimage effect are satisfactorily achieved.

The above-described object is attained with a silver halide color photographic material which contains at least one coupler represented by formula (Ia), (Ib), or (Ic):

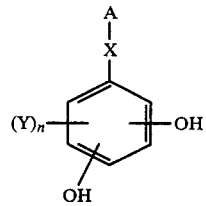

(Ia)

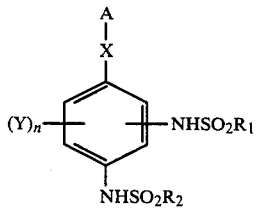

(Ib)

-continued

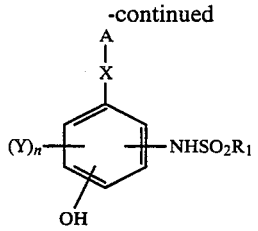

(Ic)

wherein A represents a coupler residue which can split away from the coupler by A—X bond cleavage upon reaction with an oxidation product of a developing agent; X represents an oxygen atom or a sulfur atom; $R_1$ and $R_2$ each represents an aliphatic group, an aromatic group, or a heterocyclic group; Y represents a substituent group; and n represents 0, 1, or 2, and when n is 2, the two Y's represent the same or different substituent groups, or two of substituents $R_1$, $R_2$, and Y represent divalent groups that combine with each other to form a ring structure.

DETAILED DESCRIPTION OF THE INVENTION

The couplers represented by the foregoing formula (Ia) release aromatic alcohols or aromatic thiols, each of which is subsituted with two hydroxyl groups. These compounds when released have strong reducing power, whereby oxidation products of developing agents are reduced. In addition, two hydroxy substituents (or three hydroxy substituents when X represents an oxygen atom) enhance the solubility in water, so the diffusibility of the moiety released from the coupler in an emulsion is heightened. Further, if the group represented by Y is controlled so as to have a proper size, the diffusibility of the released moiety can be easily controlled.

Couplers represented by the foregoing formula (Ib) release aromatic alcohols or aromatic thiols each of which is substituted with two or more sulfonamido groups by reaction with oxidation products of developing agents. It is necessary for one of these sulfonamido groups to be situated at the para-position to X. The bissulfonamidophenols or bissulfonamidothiophenols eliminated from A exhibit their strong reducing power, and reduce oxidation products of developing agents. In addition, two sulfonamido groups enhance moderately the solubility to water, and heighten the diffusibility also. Further, the diffusibility is also easily controlled by properly choosing the size of the substituent $R_1$, $R_2$, or Y.

Although couplers having sulfoamido groups situated at the 2- and 5-positions with respect to X are disclosed in the aforesaid Japanese Patent Application (OPI) No. 138636/82, compounds released from these couplers suffer from the fatal defect that they undergo the coupling reaction with oxidation products of developing agents at the para-position to their hydroxyl group. Accordingly, the compounds have weak reducing power and cause a problem in that dyes formed by the coupling reaction are responsible for color turbidity. On the other hand, these defects are not observed in the compounds released from the coupler (Ib) of the present invention.

Examples of the coupler which can release a phenoxy group having a sulfonamido group at the o-position are disclosed in U.S. Pat. No. 4,401,752. The couplers of this kind are used for the purpose of improving color density of the developed image, particularly reducing the amount of developed silver per amount of dye produced (equivalency). They show their capability to certain extents with respect to this purpose, and produce dyes using silver in an amount close to two equivalents required theoretically. However, the couplers (Ib) of the present invention which release a phenoxy group having sulfonamido groups at not only the o-position but also the p-position cannot function as two equivalent couplers. This is because compounds released from the couplers (Ib) have strong reducing power and thereby, oxidation products of developing agents are quickly reduced. That is, the couplers (Ib) of the present invention bring about increase in the equivalent number, and require a larger amount of silver in order to attain the same color density of the developed image. In other words, it is impossible to use the couplers (Ib) of the present invention as two equivalent couplers with the intention of heightening color density of the developed image.

Couplers represented by the foregoing formula (Ic) release aromatic alcohols or aromatic thiols each of which is substituted with a sulfonamido group and a hydroxyl group. These compounds released have a strong reducing power, and reduce oxidation products of developing agents. In addition, both the hydroxyl substituent and the sulfonamido substituent enhance moderately the solubility to water, and heighten the diffusibility of the compounds released from the couplers in emulsions. Further, the diffusibility can also be easily controlled by properly choosing the sizes of the substituents $R_1$ and Y.

The couplers of the present invention can remove effectively through their reducing power an excess portion of oxidation products of developing agents which are produced at the time of development-processing. Thereby, the growth of individual dye clouds exceeding a certain limit is suppressed, to result in preventing mottle from generating, and consequently, providing an improvement in granularity. In addition, when reducing agents released from the couplers of the present invention have great diffusibility, the edge effect and the interimage effect are observed. In particular, these effects are observed significant in color reversal photosensitive materials. In order to achieve the edge effect and the interimage effect, it has been known to use, for instance, couplers capable of releasing development inhibitors (DIR couplers). In the case of color reversal photosensitive materials, however, conventional DIR couplers are unable to exhibit their development inhibiting effect in color reversal photosensitive materials, so they cannot be used for that purpose. This is because conventional DIR couplers utilize inhibitors of the type which are adsorbed by silver halide, and their development inhibiting function yield no results in the color reversal step having great developing activity. On the other hand, the couplers of the present invention produce excellent granularity and sharpness effects, even in color reversal photosensitive materials. More specifically, compounds released from the couplers of the present invention function to capture oxidation products of developing agent in the second developing step of the color reversal photographic processing, and consume the oxidation products of the developing agents. Thereby, developable silver is consumed, to result in inhibition of color development; that is, a development inhibiting effect is produced.

Details of the couplers of the present invention are described below.

Preferred examples of the substituent group represented by Y in formulae (Ia), (Ib) and (Ic) include an aliphatic group, an aromatic group, a heterocyclic group, a halogen atom, an alkoxy group, an aryloxy group, an arylthio group, an alkoxycarbonyl group, a thioureido group, an acylamino group, a sulfonamido group, a cyano group, a nitro group, a carbamoyl group, a sulfamoyl group, an acyloxy group, an alkylthio group, an amino group, a sulfonyl group, a ureido group, an aryloxycarbonyl group, an alkoxycarbonylamino group, a sulfamoylamino group, and an acyl group. In addition, when n is 2, the substituent group represented by $(Y)_n$ is preferably

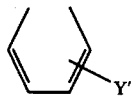

(wherein Y' has the same meaning as Y described above or represents a hydrogen atom). When these substituent groups contain an aliphatic moiety, the aliphatic moiety contains from 1 to 32 carbon atoms, preferably from 1 to 16 carbon atoms, and it may be a straight or branched chain, chain-form or cyclic, saturated or unsaturated, substituted or unsubstituted group. On the other hand, when Y contains an aryl moiety, the aryl moiety contains from 6 to 10 carbon atoms, and preferably is a substituted or unsubstituted phenyl group. Of these substituent groups, an aliphatic group, an aromatic group, an alkoxy group, an acylamino group and a sulfoamido group are more preferred for Y in formulae (Ia) and (Ic), and an aliphatic group, an aromatic group and an alkoxy group are more preferred for Y in formula (Ib).

In formulae (Ib) and (Ic), each of aliphatic groups represented by $R_1$ and $R_2$ contains from 1 to 32 carbon atoms, and preferably from 1 to 16 carbon atoms (not including carbon atoms of substituents if any), and it may be a substituted or unsubstituted, straight or branched chain, chain-form or cyclic, saturated or unsaturated group. Suitable examples of a substituent with which the aliphatic group may be substituted include a halogen atom, an aryl group, an alkoxy group, an aryloxy group, an arylthio group, an alkoxycarbonyl group, a hydroxyl group, an acylamino group, a cyano group, a nitro group, a carbamoyl group, a sulfamoyl group, a sulfonamido group, an acyloxy group, an alkylthio group, an amino group, a sulfonyl group, an acyl group, a ureido group, and an aryloxycarbonyl group. When these substituents contain an aliphatic moiety, the moiety contains from 1 to 16 carbon atoms, and it may be a straight or branched chain, chain-form or cyclic, saturated or unsaturated, substituted or unsubstituted group. On the other hand, when the substituents set forth above contain an aromatic group, the moiety contains from 6 to 10 carbon atoms, and it is preferably a substituted or unsubstituted phenyl group.

In formulae (Ib) and (Ic), each of aromatic groups represented by $R_1$ and $R_2$ contains from 6 to 10 carbon atoms (not including carbon atoms of substituents if any), and it is preferably a substituted or unsubstituted phenyl group. Suitable examples of substituents with which the aromatic group may be substituted include an aliphatic group, an aromatic group, a heterocyclic group, a halogen atom, an alkoxy group, an aryloxy group, an arylthio group, an alkoxycarbonyl group, a hydroxyl group, an acylamino group, a cyano group, a nitro group, a carbamoyl group, a sulfamoyl group, a sulfonamido group, an acyloxy group, an alkylthio group, an amino group, a sulfonyl group, a ureido group, an aryloxycarbonyl group, a carboxyl group, an acyl group, an alkoxycarbonylamino group, and sulfamoylamino group. When these substituents contain an aliphatic moiety, the moiety contains from 1 to 32 carbonatoms, preferably from 1 to 16 carbon atoms, and it may be a straight or branched chain, chain-form or cyclic, saturated or unsaturated, substituted or unsubstituted group. In another case, where the substituents set forth above contain an aromatic moiety, the moiety contains from 6 to 10 carbon atoms, and it is preferably a substituted or unsubstituted phenyl group. In still another case where the substituents set forth above contain a heterocyclic ring structure, the ring structure may be that of imidazole, pyrrole, thiophene, tetrahydrofuran, benzimidazole, pyridine, triazole, pyrazole, imidazolidine-2,4-dione, or the like.

In formulae (Ib) and (Ic), each of heterocyclic groups represented by $R_1$ and $R_2$ is preferably a 5- to 7-membered ring group containing one or more hereto atom selected from the group consisting of a nitrogen atom, a sulfur atom, an oxygen atom, and a selenium atom. Suitable examples of such rings include imidazole, pyrazole, 1,2,4-triazole, thiophene, furan, benzoimidazole, pyridine, teterahydrofuran and so on, each of which may have a certain substituent. Preferred examples of such substituents include an aliphatic group, an aromatic group, an acylamino group, a sulfonamido group, an alkoxy group, a halogen atom, an aryloxycarbonyl group, an alkoxycarbonyl group, an alkylthio group, a ureido group, a cyano group, an amino group, and an aryloxy groups. When these substituents contain an aliphatic moiety, the moiety contains from 1 to 32 carbon atoms, preferably from 1 to 16 carbon atoms, and it may be a straight or branched chain, chain-form or cyclic, saturated or unsaturated, substituted or unsubstituted group. On the other hand, when the substituents set forth above contains an aromatic moiety, the moiety contains from 6 to 10 carbon atoms, and it is preferably a substituted or unsubstituted phenyl group.

In formulae (Ia), (Ib) and (Ic), X is preferably an oxygen atom, and n is preferably 0, i.e., having no substituents represented by Y.

The couplers represented by formula (Ia) or (Ic) preferably have the two OH groups, or the OH group and the $NHSO_2R_1$ group, respectively, at the 2- and 4-positions with respect to X.

In formulae (Ia), (Ib), and (Ic), respectively, A is a coupler residue represented by formula (II), (III), (IV), (V), (VI), (VII) or (VIII):

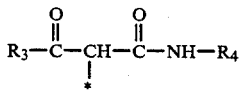

(II)

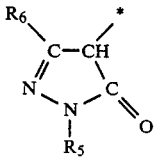

(III)

-continued

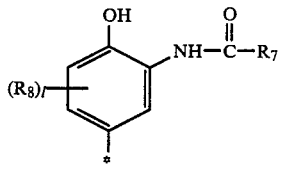

(IV)

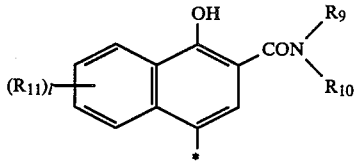

(V)

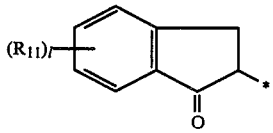

(VI)

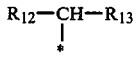

(VII)

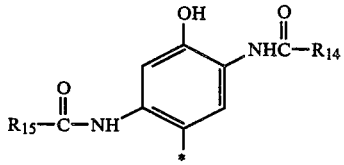

(VIII)

The free bond (indicated by *) derived from the coupling site in each of the foregoing formulae represents the bonding position of the coupling eliminable group (X in the formula (I)). When $R_3$, $R_4$, $R_5$, $R_6$, $R_7$, $R_8$, $R_9$, $R_{10}$, $R_{11}$, $R_{12}$, $R_{13}$, $R_{14}$, or $R_{15}$ in the formulae illustrated above contains a non-diffusible group, the total number of carbon atoms contained in each of $R_3$ to $R_{15}$ may range from 8 to 32, and preferably from 10 to 22. In other cases, the total number of carbon atoms contained in each group is preferably 15 or less.

Detailed descriptions of $R_3$ to $R_{15}$ and 1 in formulae (II) to (VIII) are set forth below.

In formula (II), $R_3$ represents an aliphatic group, an aromatic group, an alkoxy group, or a heterocyclic group, and $R_4$ represents an aromatic group or a heterocyclic group.

The aliphatic group represented by $R_3$ preferably contains from 1 to 22 carbon atoms and it may be substituted or unsubstituted, chain-form or cyclic group. When the aliphatic group is an alkyl group, the alkyl group may have a substituent such as an alkoxy group, an aryloxy group, an amino group, an acylamino group, and a halogen atom. The substituent may be further substituted. Preferred examples of the aliphatic group for $R_3$ include an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 1-methoxyisopropyl group, a 1-phenoxyisopropyl group, a 1-p-tert-butylphenoxyisopropyl group, an α-aminoisopropyl group, an α-(diethylamino)isopropyl group, an α-(succinimido)isopropyl group, an α-(phthalimido)isopropyl group, and an α-(benzenesulfonamido)isopropyl group.

The aromatic group (particularly a phenyl group) represented by $R_3$ or $R_4$ may be substituted by an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido group, an alkylsubstituted succinimido group, or so on, each of which contains not more than 26 carbon atoms. The above-described alkyl groups may include those containing an arylene group like a phenylene group in their chain structures. When the aromatic group is a phenyl group, the phenyl group may be substituted with, in addition to the groups set forth above, an aryloxy group, an aryloxycarbonyl group, an arylcarbamoyl group, an arylamido group, an arylsulfamoyl group, an arylsulfonamido group, an arylureido group, or so on. Each of aryl moieties contained in these substituent groups may further be substituted with one or more of an alkyl group containing from 1 to 22 carbon atoms.

Moreover, a phenyl group represented by $R_3$ or $R_4$ may be substituted with an amino group including one substituted with a lower alkyl group containing from 1 to 6 carbon atoms, a hydroxyl group, a carboxyl group, a sulfo group, a nitro group, a cyano group, a thiocyano group, or a halogen atom.

Further, a phenyl group represented by $R_3$ or $R_4$ may be a group formed by fusing together the phenyl group and another ring, such as a naphthyl group, a quinolyl group, an isoquinolyl group, a chromanyl group, a coumaranyl group, a tetrahydronaphthyl group, or the like. These substituents may themselves be further substituted.

When $R_3$ represents an alkoxy group, its alkyl moiety includes a straight or branched chain alkyl or alkenyl group containing from 1 to 32 carbon atoms, preferably from 1 to 22 carbon atoms, and a cycloalkyl or cycloalkenyl group, each of which may be substituted with a halogen atom, an aryl group, an alkoxy group or so on.

A heterocyclic group represented by $R_3$ pr $R_4$ is attached to the carbon atom of the acyl carbonyl group or the nitrogen atom of the amido group, respectively, in the α-acetylacetoamido group, through one of carbon atoms which form its ring. Specific examples of such heterocyclic rings include thiophene, furan, pyran, pyrrole, pyrazole, pyridine, pyrazine, pyrimidine, pyridazine, indolizine, imidazole, thiazole, oxazole, triazine, thiadiazine, oxazine and like rings. These rings each may further have a substituent group on the ring.

In formula (III), $R_5$ represents a straight or branched chain alkyl group containing from 1 to 32 carbon atoms, preferably from 1 to 22 carbon atoms (e.g., methyl, isopropyl, tert-butyl, hexyl, dodecyl, etc.), an alkenyl group (e.g., allyl, etc.), a cycloalkyl group (e.g., cyclopentyl, cyclohexyl, norbornyl, etc.), an aralkyl group (e.g., benzyl, β-phenylethyl, etc.), or a cycloalkenyl group (e.g., cyclopentenyl, cyclohexenyl, etc.), each of which may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkyl sulfonyl group, an arylthio group, an alkylthio group, an alkylamino group, a dialkylamino group, an anilino group, an N-arylanilino group, an N-alkylanilino group, an N-acylanilino group, a hydroxyl group, and so on.

Further, $R_5$ may represent an aryl group (e.g., phenyl, α-naphthyl, β-naphthyl, etc.). The aryl group may have one or more of a substituent. Specific examples of such a substituent include an alkyl group, an alkenyl group, a cycloalkyl group, an aralkyl group, a cycloalkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxyl group and so on. Of these aryl groups, a phenyl group which is substituted with an alkyl group, an alkoxy group, a halogen atom or the like at at least one of the o-positions is more preferred as $R_5$. This is because when the resulting couplers remain in a photosensitive film, little coloration thereof is caused by light or heat. Thus, they are very useful.

Furthermore, $R_5$ may represent a heterocyclic group (e.g. a 5- or 6-membered heterocyclic group containing nitrogen, oxyten or/and sulfur atoms, which may form a condensed ring by fusing together with another ring, with specific examples including a pyridyl group, a quinolyl group, a furyl group, a benzothiazolyl group, an oxazolyl group, an imidazolyl group, a naphthooxazolyl group, and the like), a substituted heterocyclic group whose substituents are included in those set forth with respect to the above-described aryl group for $R_5$, an aliphatic or aromatic acyl group, an alkylsulfonyl group, an arylsulfonyl group, an alkylcarbamoyl group, an arylcarbamoyl group, an alkylthiocarbamoyl group, or an arylthiocarbamoyl group.

In the foregoing formula (III), $R_6$ represents a hydrogen atom, a straight or branched chain alkyl group containing from 1 to 32 carbon atoms, preferably from 1 to 22 carbon atoms, an alkenyl group, a cycloalkyl group, an aralkyl group, a cycloalkenyl group (which groups each may have one or more of the substituents set forth with respect to $R_5$), an aryl or heterocyclic group (which may have one or more of the substituents set forth with respect to $R_5$), an alkoxycarbonyl group (e.g., methoxycarbonyl, ethoxycarbonyl, stearyloxycarbonyl, etc.), an aryloxycarbonyl group (e.g., phenoxycarbonyl, naphthoxycarbonyl, etc.), an aralkyloxycarbonyl group (e.g., benzyloxycarbonyl, etc.), an alkoxy group (e.g., methoxy, ethoxy, heptadecyloxy, etc.), an aryloxy group (e.g., phenoxy, tolyoxy, etc.), an alkylthio group (e.g., ethylthio, dodecylthio, etc.), an arylthio group (e.g., phenylthio, α-naphthylthio, etc.), a carboxyl group, an acylamino group (e.g., acetylamino, 3-[(2,4-di-tert-amylphenoxy)acetamido]benzamido, etc.), a diacylamino group, an N-alkylacylamino group (e.g., N-methylpropionamido, etc.), an N-arylacylamino group (e.g., N-phenylacetamido, etc.), a ureido group, (e.g., ureido, N-arylureido, N-alkylureido, etc.), a urethane group, a thiourethane group, an arylamino group (e.g., phenylamino, N-methylanilino, diphenylamino, N-acetylanilino, 2-chloro-5-tetradecanamidoanilino, etc.), an alkylamino group (e.g., n-butylamino, methylamino, cyclohexylamino, etc.), a cycloamino group (e.g., piperidino, pyrrolidino, etc.), a heterocyclic amino group (e.g., 4-pyridylamino, 2-benzoxazolylamino, etc.), an alkylcarbonyl group (e.g., methylcarbonyl, etc.), an arylcarbonyl group (e.g., phenylcarbonyl, etc.), a sulfonamido group (e.g., alkylsulfonamido, arylsulfonamido, etc.), a carbamoyl group (e.g., ethylcarbamoyl, dimethylcarbamoyl, N-methyl-phenylcarbamoyl, N-phenylcarbamoyl, etc.), a sulfamoyl group (e.g., N-alkylsulfamoyl, N,N-dialkylsulfamoyl, N-arylsulfamoyl, N-alkyl-N-arylsulfamoyl, N,N-diarylsulfamoyl, etc.), a cyano group, or a hydroxyl group.

In formula (IV), $R_7$ represents an aliphatic group, or an aromatic group. Preferred aliphatic groups contain from 1 to 22 carbon atoms, and they may be substituted or unsubstituted chain-form or cyclic groups. Substituents suitable for these aliphatic groups include an alkoxy group, an alkylthio group, an aryloxy group, a carboxyl group, a halogen atom, an acylamino group and so on, which themselves may be further substituted. Specific examples of useful aliphatic groups as $R_7$ include a dodecyl group, a hexadecyl group, a dodecyloxypropyl group, a cyclohexyl group, a tert-butyl group, a n-butyl group, a 3-(2,4-di-tert-amylphenoxy)propyl group, a 1-(2,4-di-tert-amylphenoxy)propyl group and so on.

When $R_7$ represents an aromatic group, it may have one or more of the substituents set forth in the above-described case where $R_3$ is an aryl group.

In formula (IV), $R_8$ represents an aliphatic group (e.g., methyl, ethyl, etc.), a halogen atom (e.g. chlorine, fluorine, etc.), an alkoxy group (e.g., methoxy, ethoxy, etc.), or an aromatic group (e.g., phenyl).

In the foregoing formula (V), $R_9$ and $R_{10}$ each represents a hydrogen atom, an aliphatic group, or an aromatic group. When $R_9$ or $R_{10}$ represents an aliphatic group, it contains from 1 to 32 carbon atoms, preferably from 1 to 18 carbon atoms, and may be a substituted or unsubstituted chain-form or cyclic group. Suitable examples of groups with which the aliphatic group may be substituted include an aryloxy groups, an alkoxy group, a halogen atom, an aryl group, a hydroxyl group, a carboxyl group, a cyano group, a nitro group, an alkoxycarbonyl group, an acylamino group, a sulfonamido group, an acyloxy group, each of which may be further substituted. Specific examples of aliphatic groups useful as $R_9$ or $R_{10}$ include a dodecyl group, a hexadecyl group, a dodecyloxypropyl group, a cyclohexyl group, a tert-butyl group, a 3-(2,4-di-tert-amylphenoxy)propyl group, a 1-(2,4-di-tert-amylphenoxy)propyl group, and so on.

When $R_9$ or $R_{10}$ represents an aromatic group, the aromatic group contains from 6 to 10 carbon atoms, and preferably is a substituted or unsubstituted phenyl group. Suitable examples of groups with which the phenyl group may be substituted include an alkoxy group, an aliphatic group, an acylamino group, an alkoxycarbonyl group, a halogen atom, a sulfonamido group, a sulfamoyl group, a carbamoyl group, a carboxyl group, a hydroxyl group, a cyano group, a nitro group, and so on. Specific examples of aromatic groups useful as $R_9$ or $R_{10}$ include a 2-tetradecyloxyphenyl group, a 4-tetradecyloxyphenyl group, a 3-dodecyloxycarbonylphenyl group, a 2-chloro-5-dodecyloxycarbonylphenyl group, a phenyl group, a 4-carboxyphenyl group, and so on.

In formula (V) and (VI), $R_{11}$ represents a halogen atom, an acylamino group (e.g., acetamido, 2,4-di-tert-amylphenoxyacetamido, etc.), a sulfonamido group (e.g., methanesulfonamido, hexadecylsulfonamido, etc.), an alkoxy group (e.g., methoxy, dodecyloxy, etc.), or an aliphatic group (e.g., methyl, ethyl, etc.).

In formula (VII), $R_{12}$ represents an arylcarbonyl group, an alkanoyl group containing from 2 to 32 carbon atoms, preferably from 2 to 22 carbon atoms, an arylcarbamoyl, group, an alkanecarbamoyl group containing from 2 to 32 carbon atoms, preferably from 2 to 22 carbon atoms, an alkoxycarbonyl group containing from 2 to 32 carbon atoms, preferably from 2 to 22 carbon atoms, or an aryloxycarbonyl group. These groups each may have a substituent group. Suitable examples of substituents thereof include an alkoxy group, an alkoxycarbonyl group, an acylamino group, an alkylsulfamoyl group, an alkylsulfonamido group, an alkylsuccinimido group, a halogen atom, a nitro group, a carboxyl group, a nitrile group, an alkyl group, an aryl group, and so on.

$R_{13}$ in formula (VII) represents an arylcarbonyl group, an alkanoyl group containing from 2 to 32 carbon atoms, preferably from 2 to 22 carbon atoms, an arylcarbamoyl group, an alkanecarbamoyl group containing from 2 to 32 carbon atoms, preferably from 2 to 22 carbon atoms, an alkoxycarbonyl group containing from 2 to 32 carbon atoms, preferably from 2 to 22 carbon atoms, an aryloxycarbonyl group, an alkanesulfonyl group containing from 1 to 32 carbon atoms, preferably from 1 to 22 carbon atoms, an arylsulfonyl group, an aryl group, or 5- or 6-membered heterocyclic group (which contains nitrogen, oxygen, or/and sulfur atoms as hetero atoms, with specific examples including a triazolyl group, an imidazolyl group, a phthalimido group, a succinimido group, a furyl group, a pyridyl group or a benzotriazolyl group). These groups each may have one or more of the substituents set forth with respect to the above-described $R_{12}$.

In formula (VIII), $R_{14}$ represents an aliphatic group, an aromatic group, a heterocyclic group, or an anilino group. Suitable examples of such aliphatic, aromatic, and heterocyclic groups include those set forth with respect to $R_3$. When $R_{14}$ represents an anilino group, its phenyl moiety may have one or more of the substituents described above for the case where $R_5$ represents a phenyl group. Examples of groups preferred as $R_{14}$ include a pentafluoropropyl group, a 1,1,2,2,3,3-hexafluoropropyl group, a p-cyanoanilino group, a 3,4-dichloroanilino group, a p-propanesulfonylanilino group, a 2-ethanesulfonamidophenyl group, and so on.

In formula (VIII), $R_{15}$ represents an aliphatic group or an aromatic group, exemplified by those set forth with respect to $R_5$. Suitable examples of groups represented by $R_{15}$ include a tert-butyl group, a 1-(2,4-di-tert-amylphenoxy)propyl group, a 1-(2,4-di-tert-amylphenoxy)pentyl group, an isoamyl group, a 1-(2,4-di-tert-octylphenoxy)heptyl group, and so on.

In formulae (IV), (V) and (VI), l is 0, 1 or 2, and when l is 2, the two $R_8$'s or $R_{11}$'s represent the same or different groups.

The couplers represented by formula (Ia) produce more desirable effects when used in combination with other conventional couplers. They are generally used in an amount of from 0.001 to 0.8 mol, preferably from 0.1 to 0.5 mol, per mol of conventional coupler in the material.

Also, it is desired that the couplers represented by formula (Ib) or those represented by formula (Ic) are used in combination with other conventional couplers. They are generally used in an amount of from $1\times10^{-4}$ to 1 mol, preferably from 0.05 to 0.5 mol, per mol of conventional coupler in the material.

Specific examples of the couplers of the present invention are illustrated below. However, the present invention should not be construed as being limited to these examples.

Compounds represented by formula (Ia);

(1)

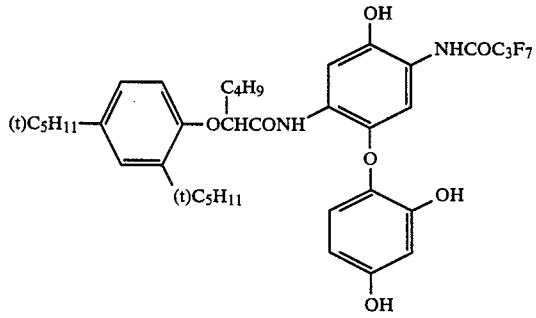

(2)

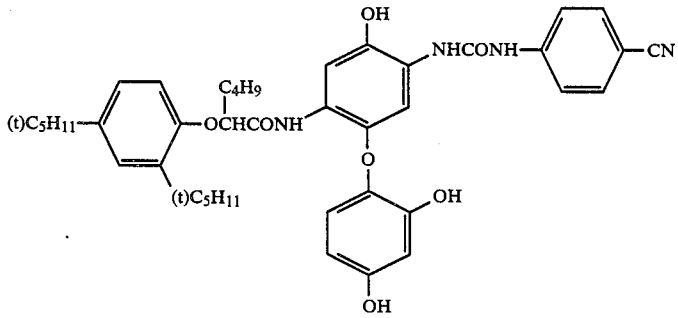

-continued
(3)
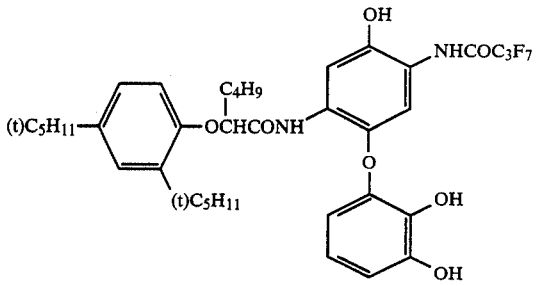
(4)
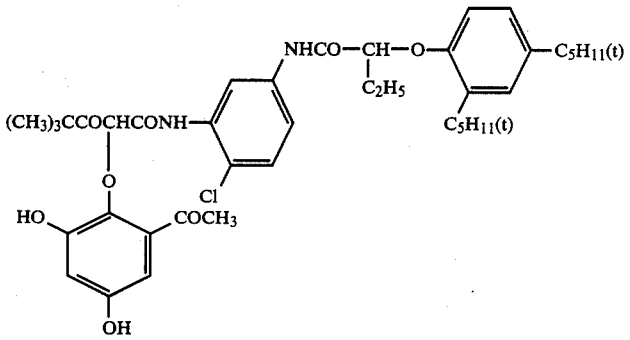
(5)
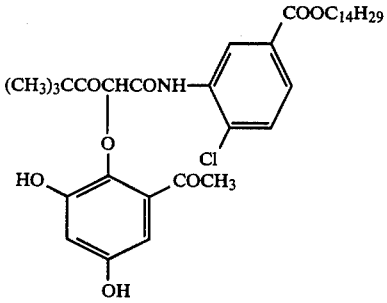
(6)
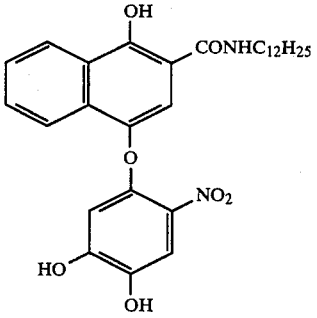
(7)
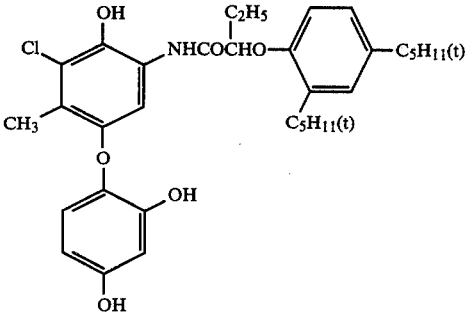
(8)
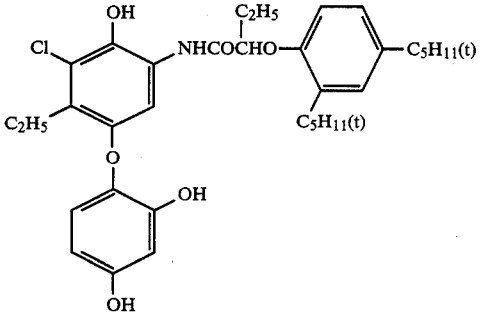
(9)
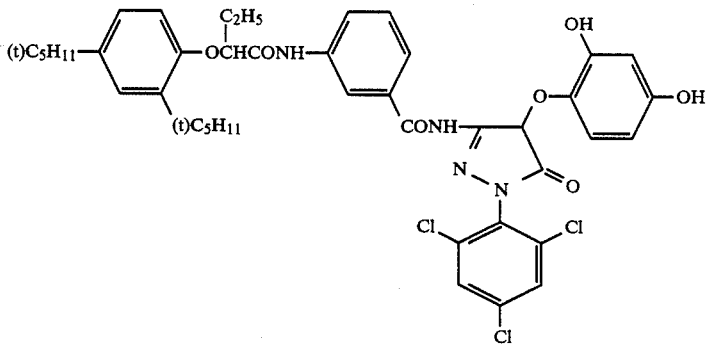

-continued
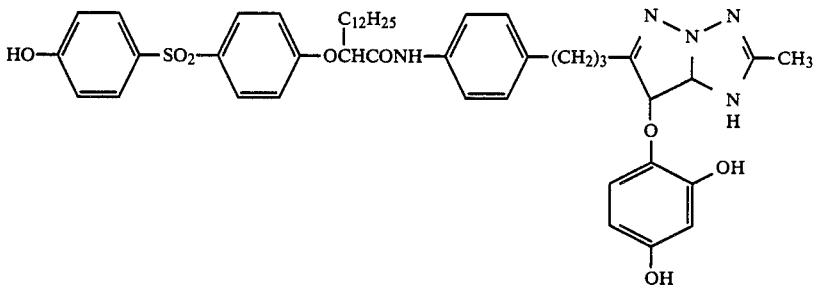
(10)
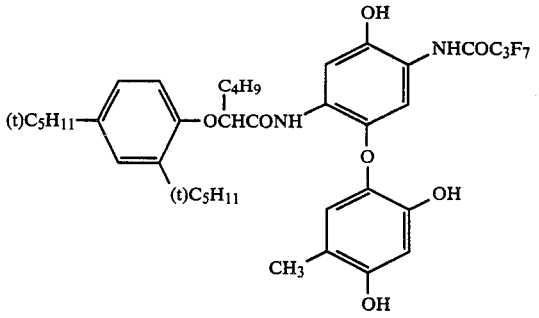
(11)
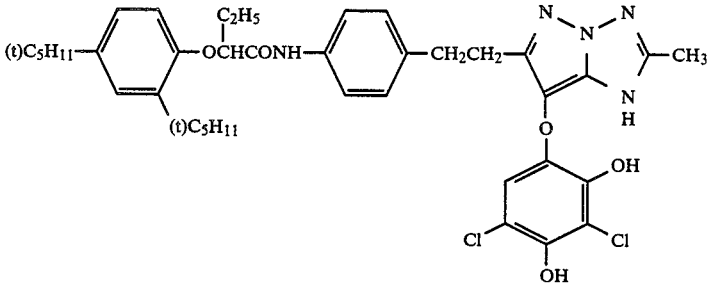
(12)
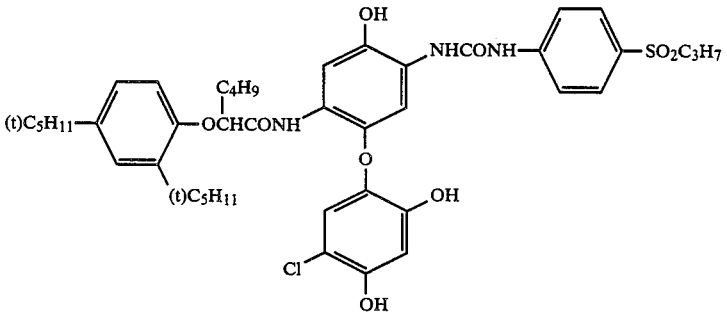
(13)
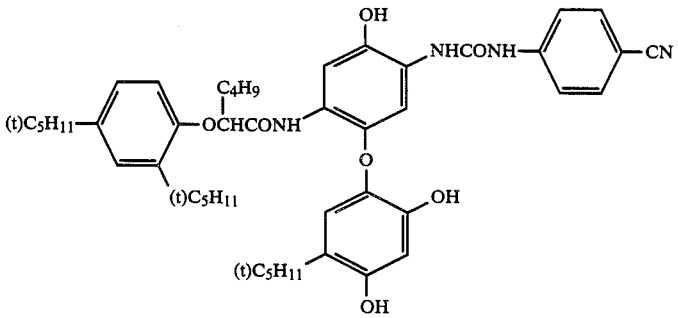
(14)

-continued
(15)
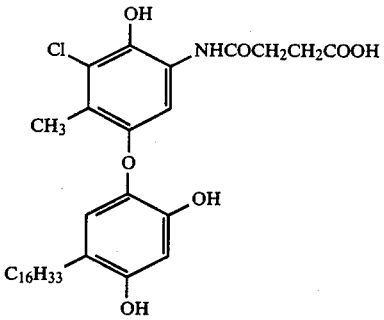
(16)
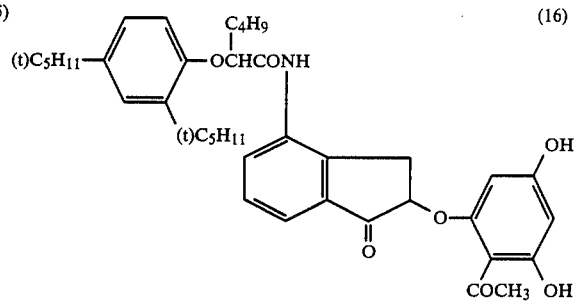
(17)
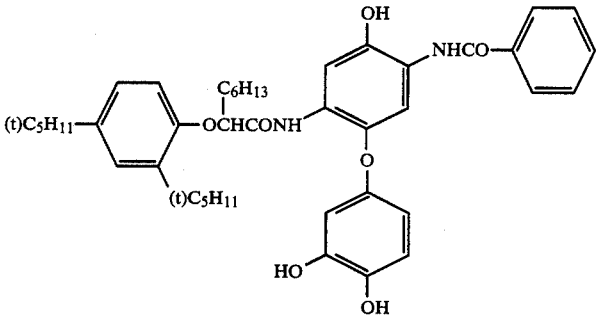
(18)
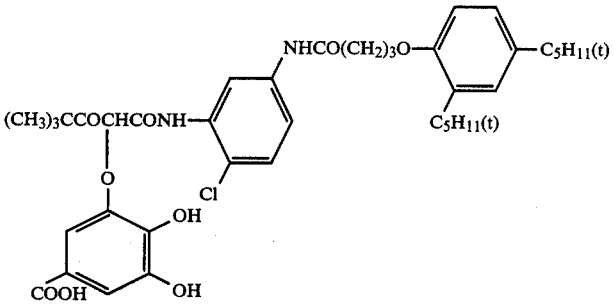
(19)
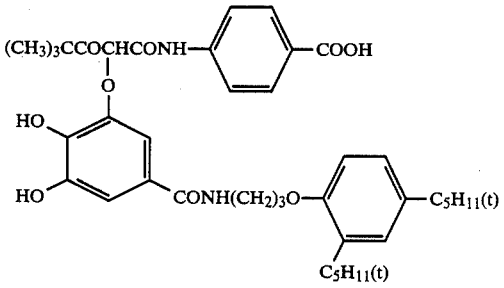
(20)
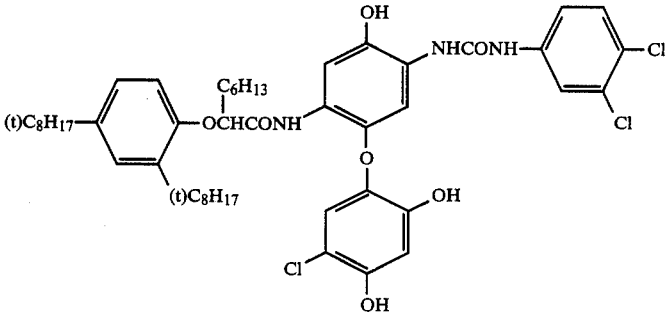

-continued
(21)
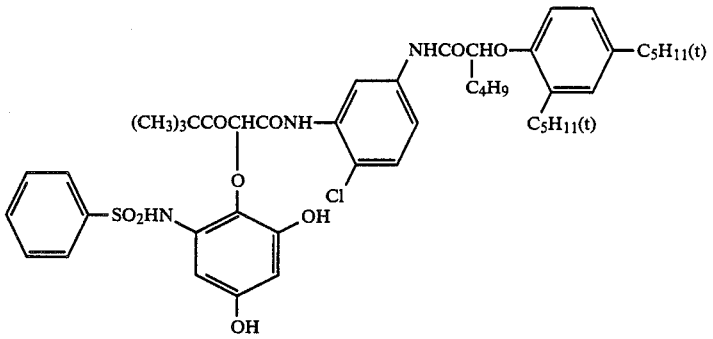
(22)
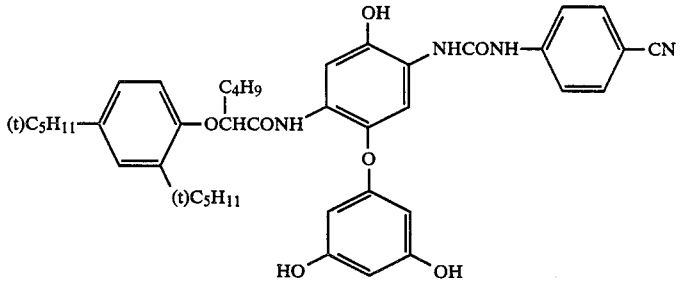
(23)
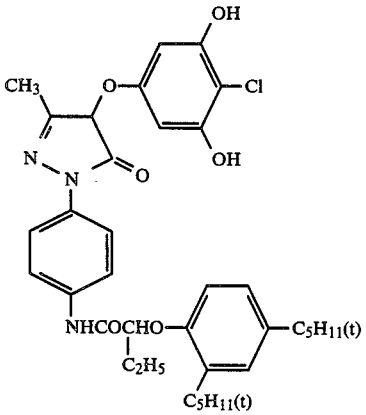
(24)
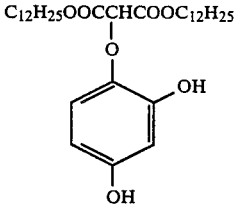
(25)
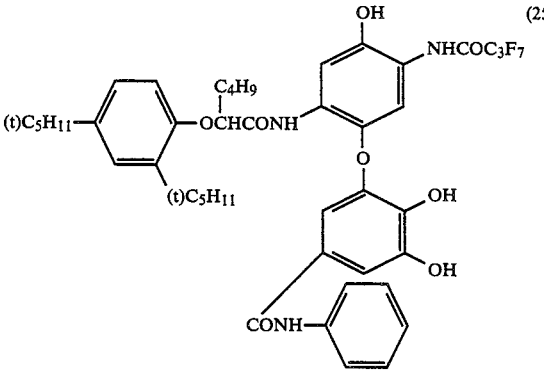
(26)
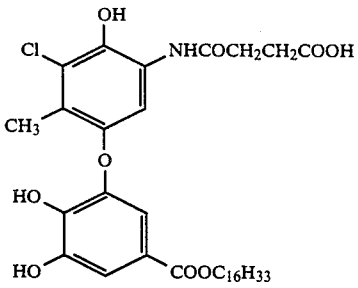
Compounds represented by formula (Ib);

-continued
(27)
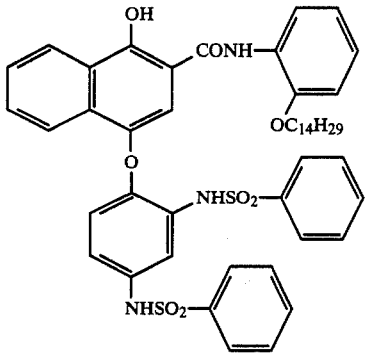
(28)
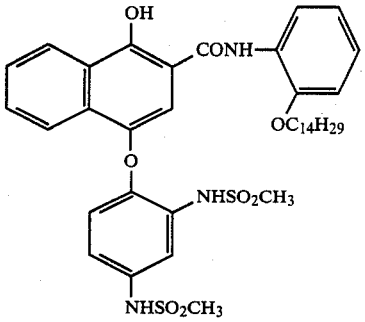
(29)
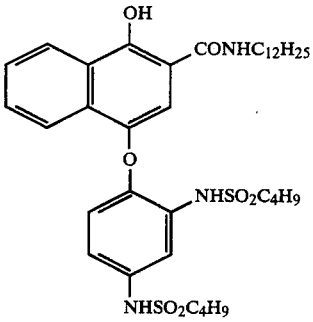
(30)
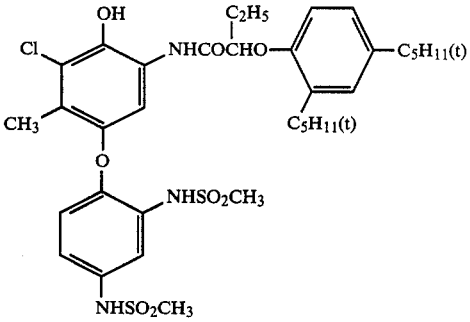
(31)
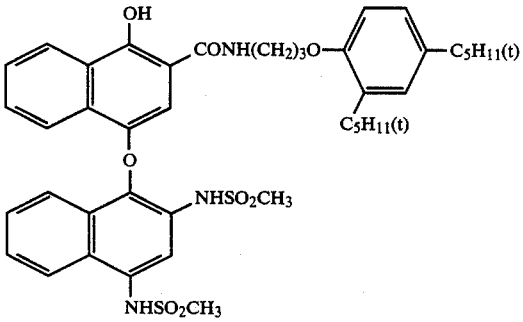
(32)
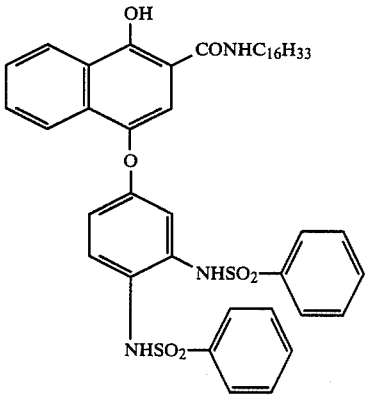
(33)
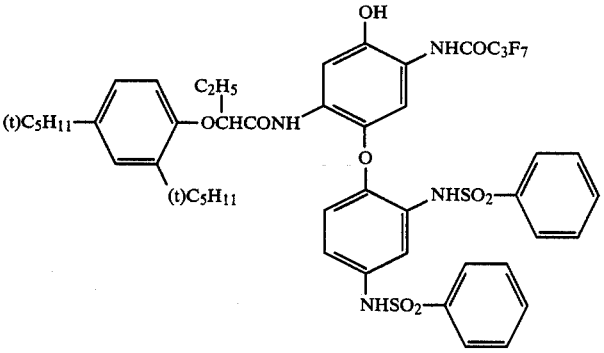

-continued
(34)
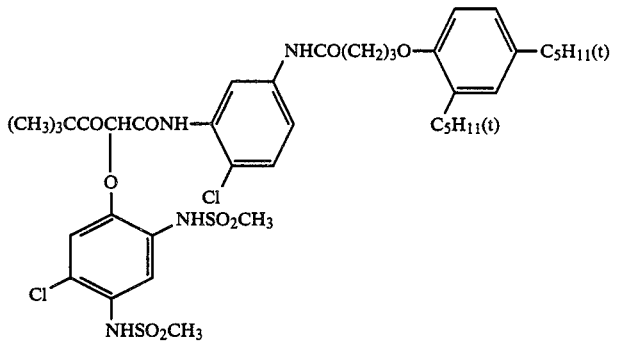
(35)
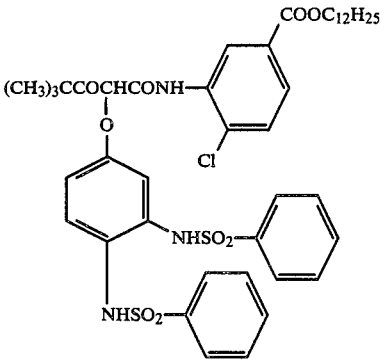
(36)
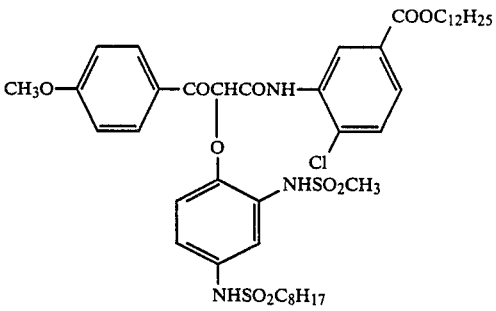
(37)
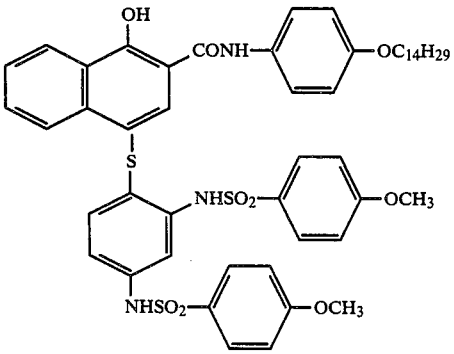
(38)
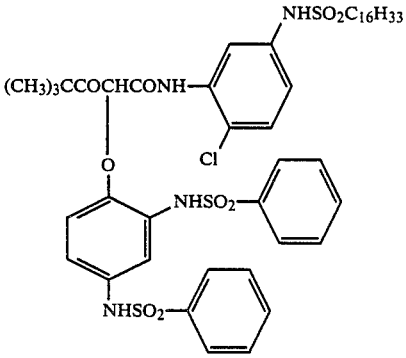
(39)
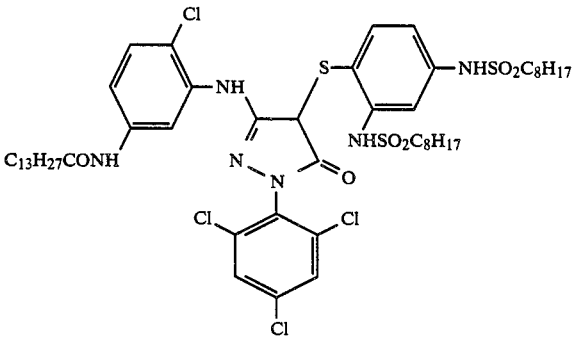

-continued
(40)
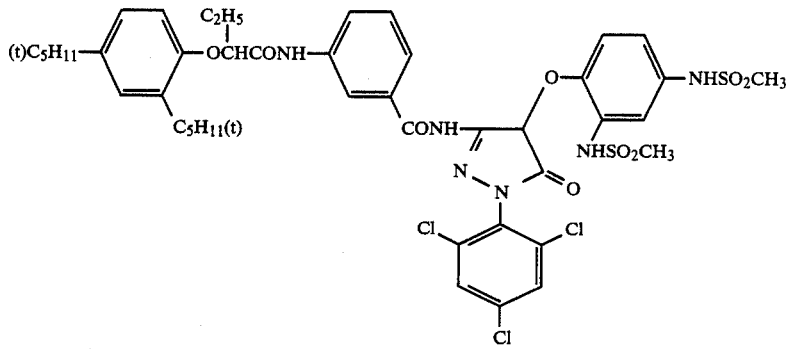
(41)
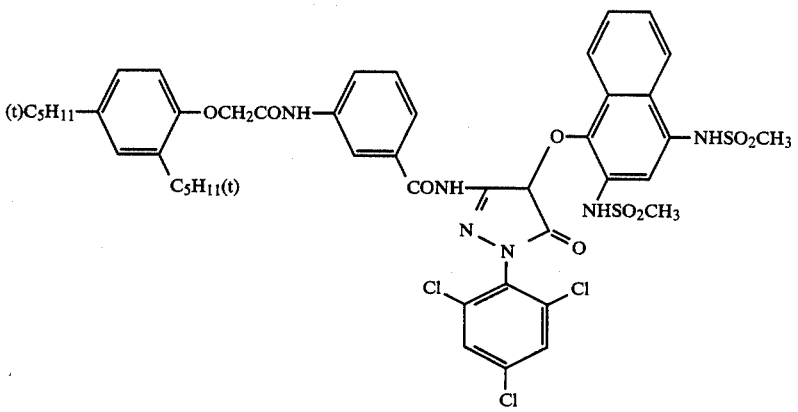
(42)
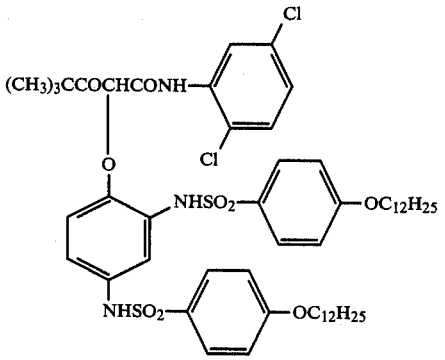
(43)
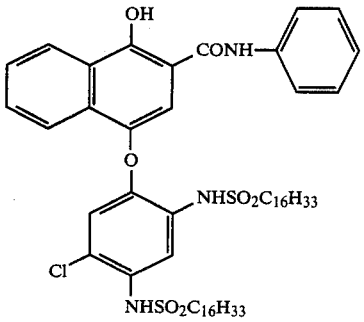
(44)
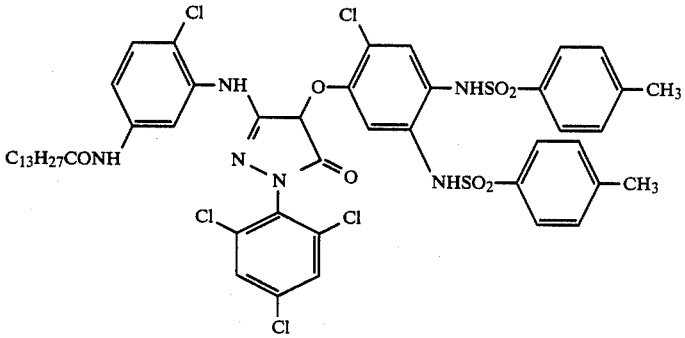

-continued
(45)
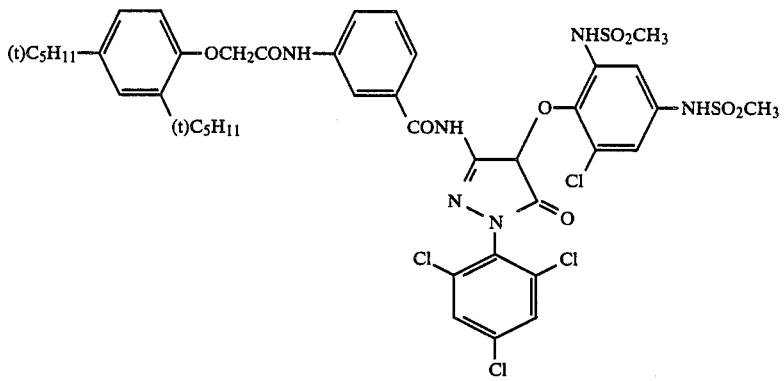
(46)
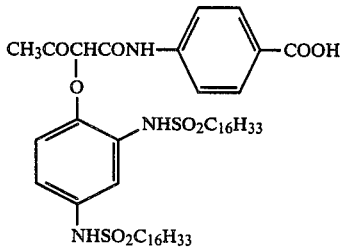
(47)
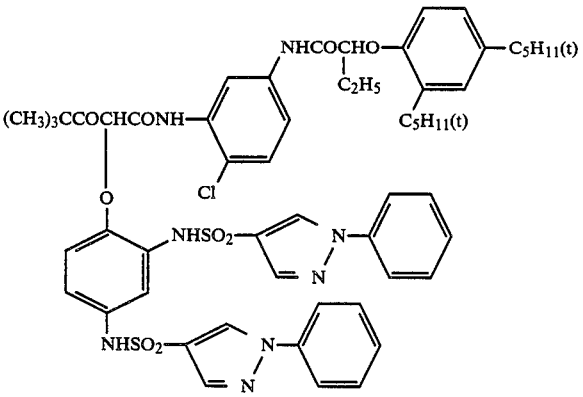
(48)
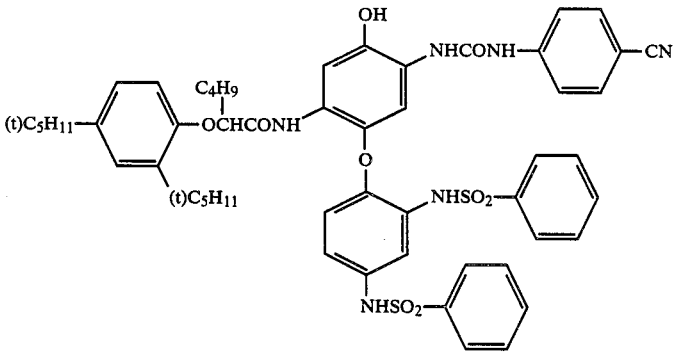

-continued
(49)
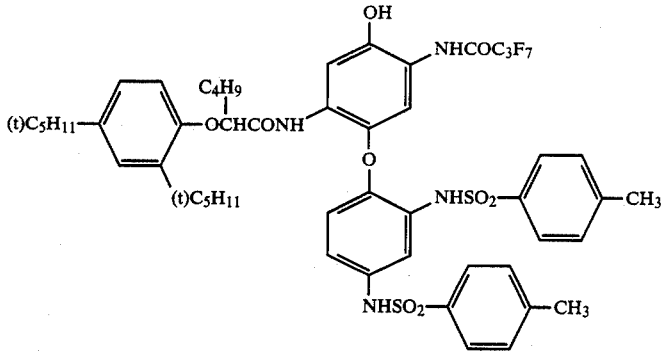
(50)
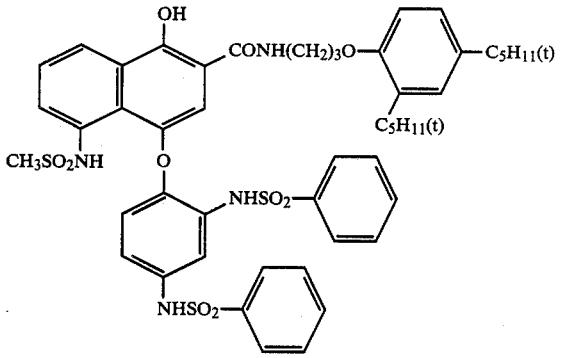
Compounds represented by formula (Ic);
(51)
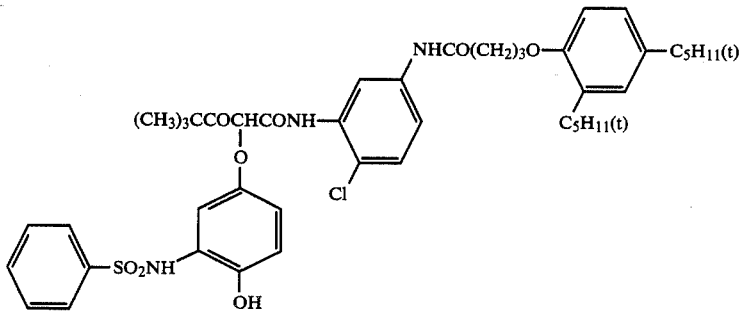
(52)
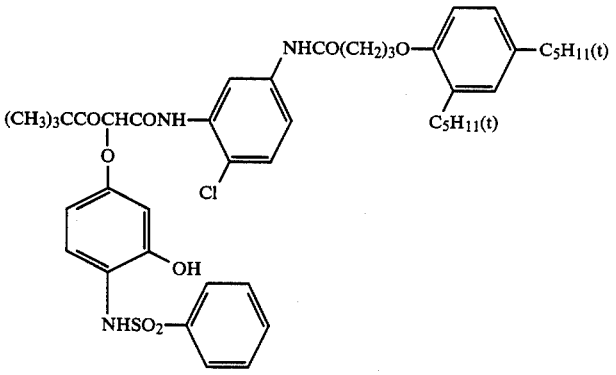

-continued
(53)
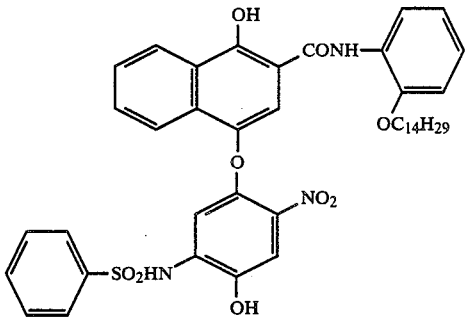
(54)
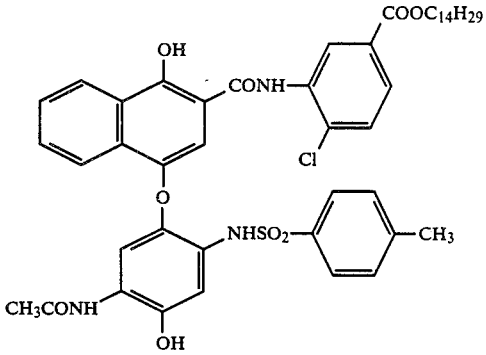
(55)
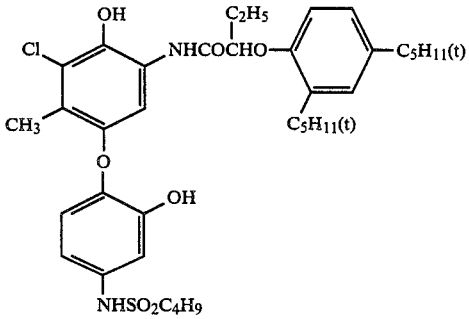
(56)
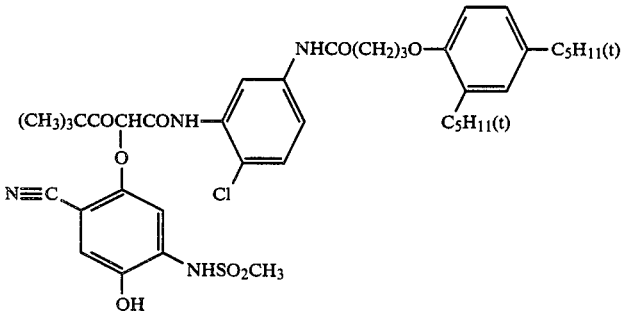
(57)
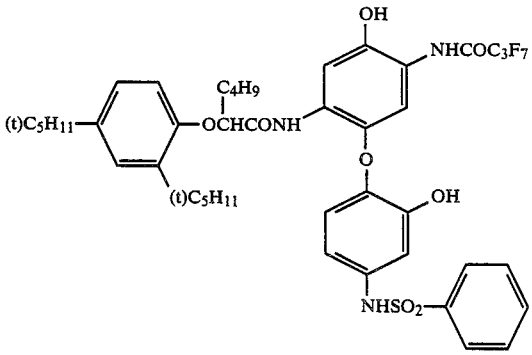

-continued
(58)
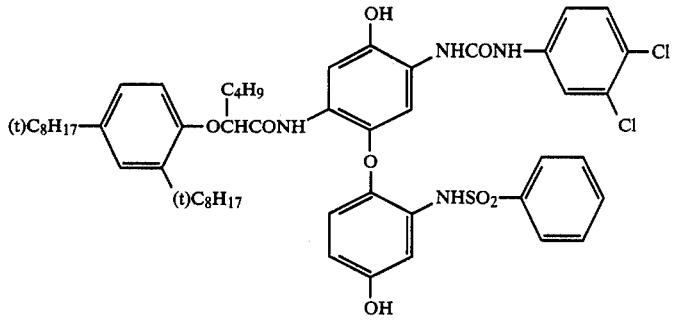
(59)
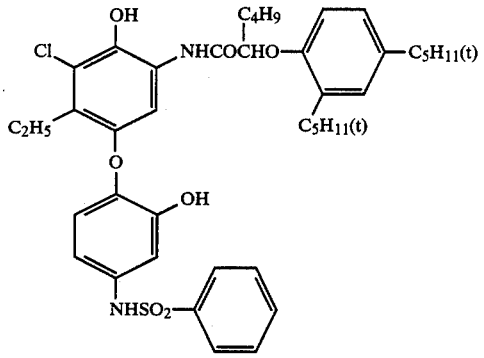
(60)
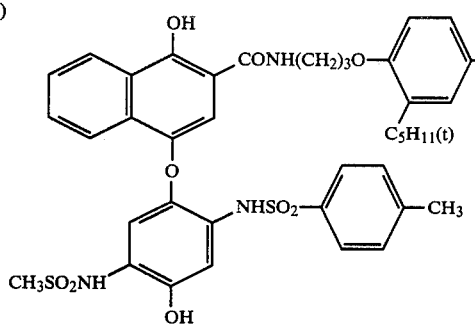
(61)
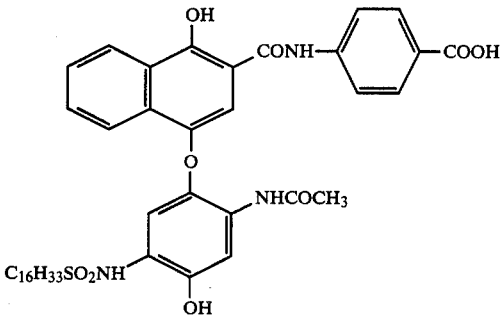
(62)
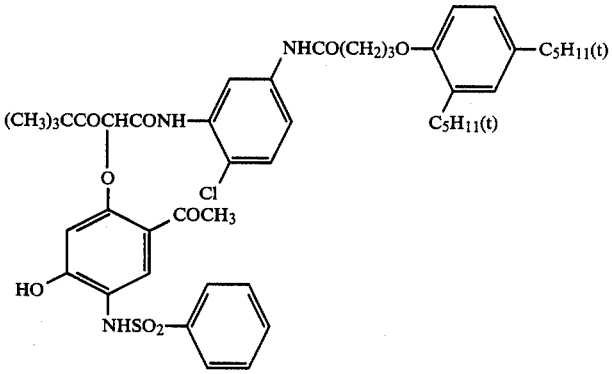

-continued
(63)
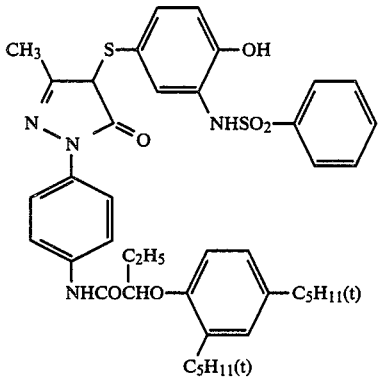
(64)
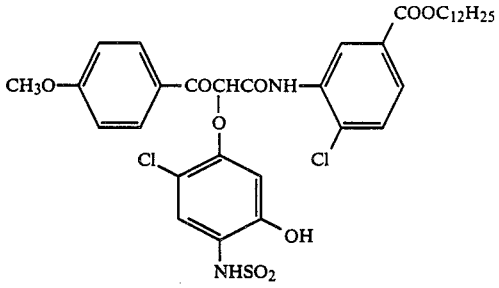
(65)
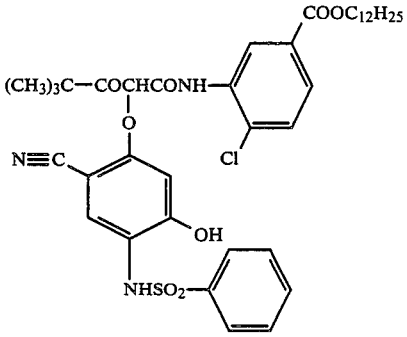
(66)
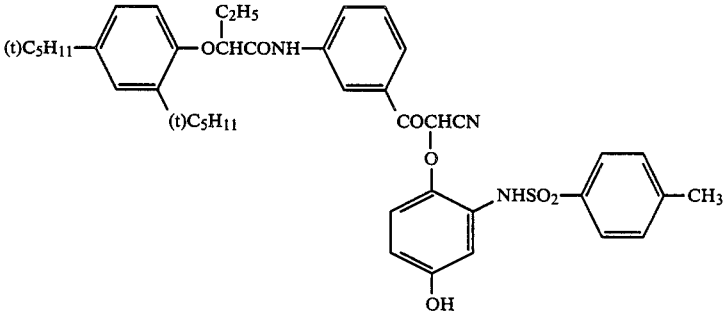
(67)
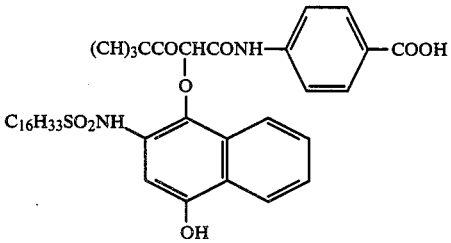
(68)
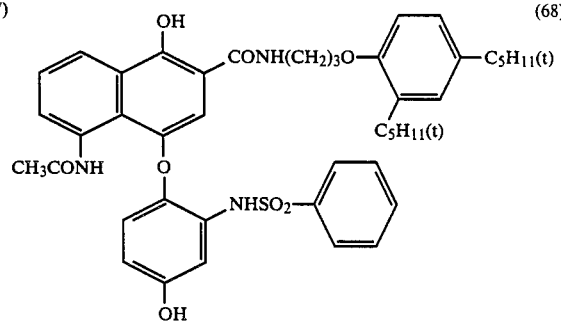

-continued
(69)
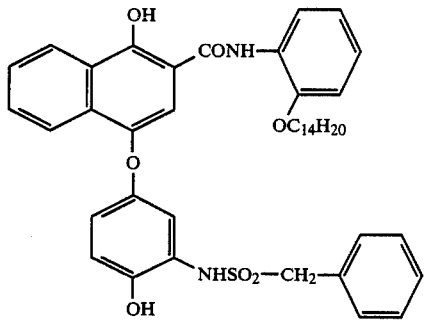
(70)
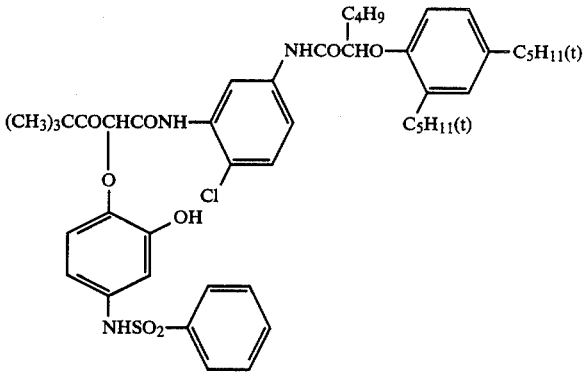
(71)
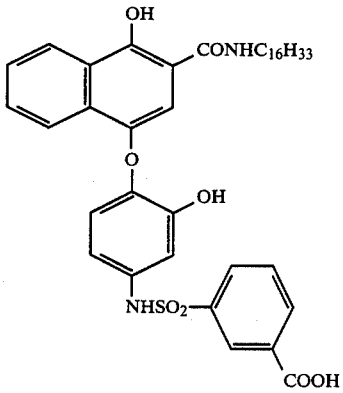
(72)
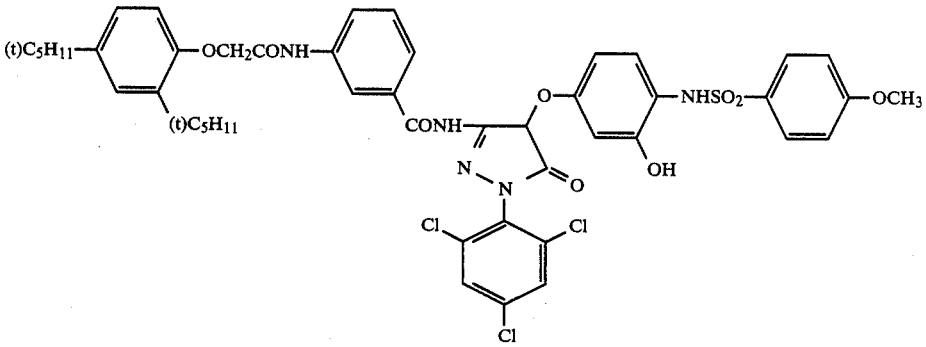

-continued
(73)
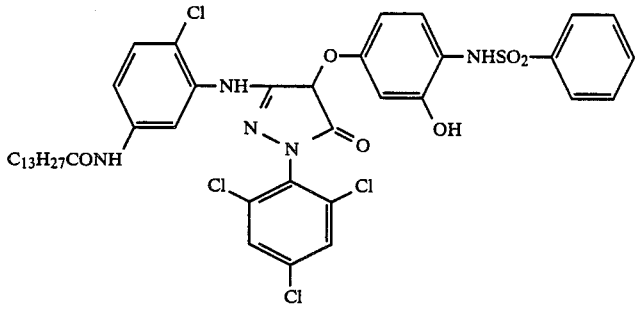
(74)
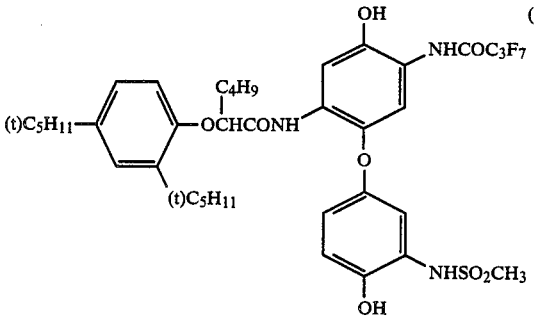
(75)
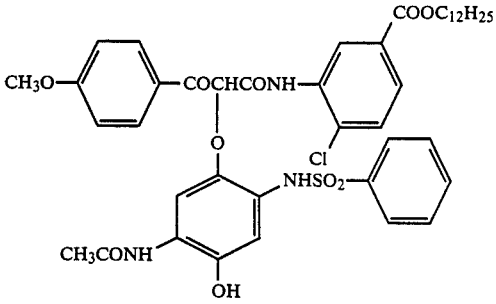
(76)
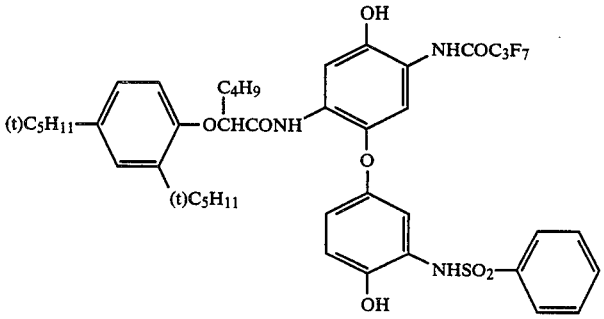
(77)
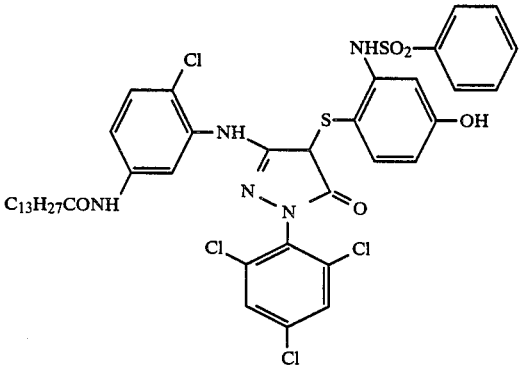
Methods for synthesizing the couplers of the present invention are illustrated in detail below.
SYNTHESIS EXAMPLE 1
Synthesis of Compound (1)
Compound (1) was synthesized taking the following route.
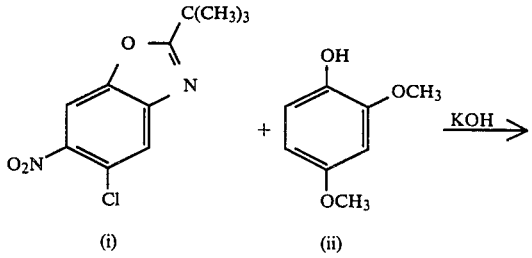

-continued

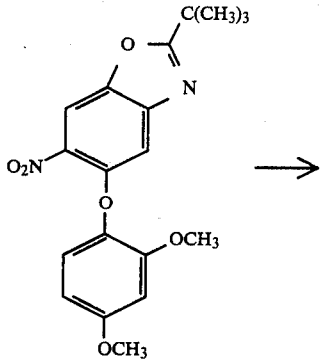

(iii)

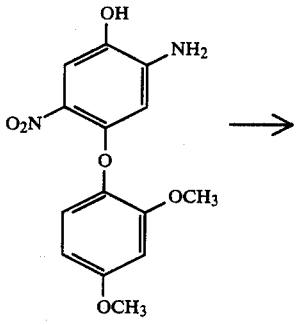

(iv)

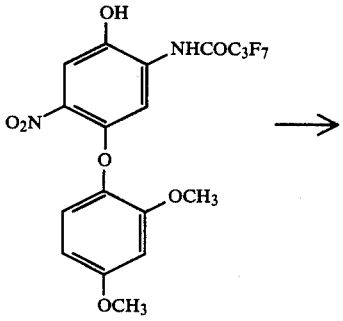

(v)

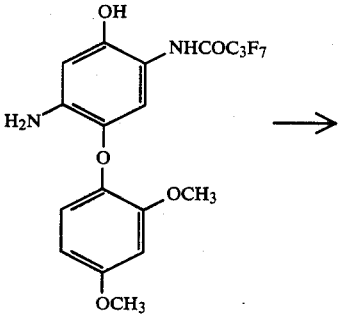

(vi)

-continued

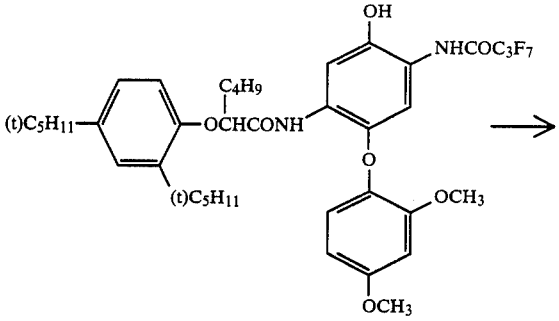

(vii)

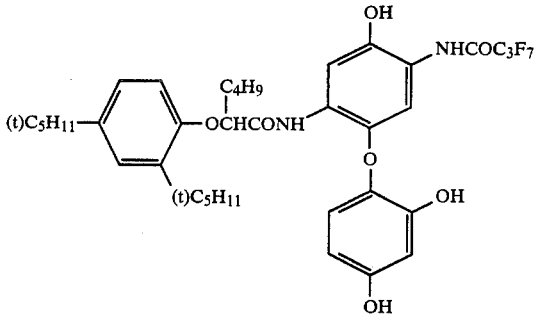

Compound (1)

(1) Synthesis of Compound (iii)

30 g of Compound (ii) and 12.1 g of potassium hydroxide were refluxed in toluene under heating and thereby, the solvent was distilled away to yield the potassium salt of Compound (ii). To this salt was added 200 ml of an N,N-dimethylformamide solution containing 45 g of Compound (i). The reaction was run at 90° C. for 5 hours. After post-treatment of the reaction product, 52 g of Compound (iii) was obtained.

(2) Synthesis of Compound (iv)

52 g of Compound (iii) was added to 500 ml of 10% hydrous ethanol containing 40 g of potassium hydroxide to undergo the reaction at room temperature for 5 hours. The reaction product was post-treated in a conventional manner to yield 27 g of Compound (iv).

(3) Synthesis of Compound (v)

27 g of Compound (iv) was added to 500 ml of ethyl acetate and thereto, 36 g of anhydrous heptafluorobutyric acid was added dropwise at room temperture. After one hour reaction, the product was post-treated in a conventional manner to yield 36 g of Compound (v).

(4) Synthesis of Compound (vi)

To a mixed solvent consisting of 400 ml of isopropanol, 40 ml of water and 40 ml of acetic acid was added 40 g of iron powder. The resulting mixture was stirred at 80° C. for 10 minutes. Thereto, 36 g of Compound (v) was added, and refluxed for 1 hour under heating. After carrying out a conventional post-treatment, 32 g of Compound (vi) was obtained.

(5) Synthesis of Compound (vii)

32 g of Compound (vi) was added to 300 ml of acetonitrile and refluxed under heating. Thereto, 25 g of 2-(2,4-di-tert-amylphenoxy)hexanoyl chloride was added dropwise. After reacting for one hour under reflux, conventional post-treatment was carried out to yield 38 g of Compound (vii).

(6) Synthesis of Compound (1)

To 300 ml of methylene chloride, 38 g of Compound (vii) was added, and cooled to 0° C. Thereafter, 42 g of boron tribromide was added to the cooled solution. After the dropwise addition, these ingredients were allowed to react with each other at a temperature of 10° C. or lower over a period of 3 hours. The reaction mixture was slowly added to 1 liter of water saturated with sodium hydrogen carbonate for the purpose of neutralization. Then, the resulting mixture was separated into two phases using a separatory funnel. After washing with water, the oily phase was concentrated, and the residue was recrystallized from ethyl acetate and hexane. Thus, the desired Coupler (1) was obtained in a yield of 28 g.

SYNTHESIS EXAMPLE 2

Synthesis of Compound (2)

Compound (2) was synthesized in the same manner as in Synthesis Example 1 except that p-cyanophenylisocyanate was employed in place of anhydrous heptafluorobutyric acid in the step (3) of Synthesis Example 1.

SYNTHESIS EXAMPLE 3

Synthesis of Compound (3)

Compound (3) was synthesized in the same manner as in Synthesis Example 1 except that 2,3-dimethoxyphenol was employed in place of Compound (ii) in the step (1) of Synthesis Example 1.

SYNTHESIS EXAMPLE 4

Synthesis of Compound (27)

Compound (27) was synthesized taking the following route.

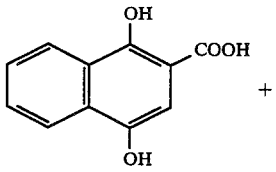

(viii)

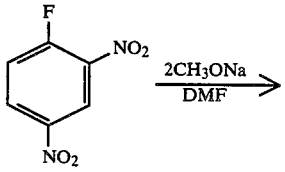

(ix)

-continued

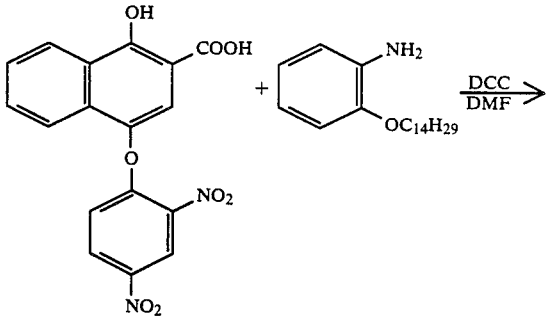

(x)

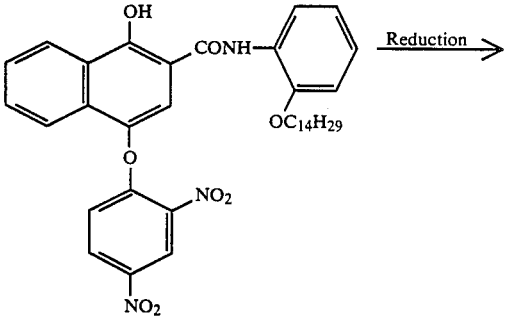

(xi)

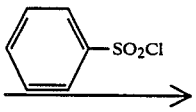

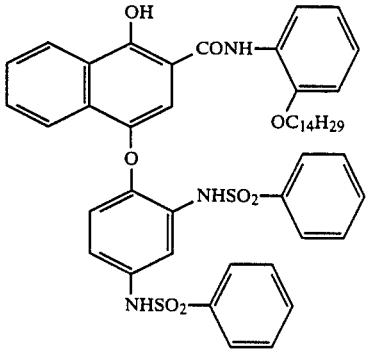

Compound (27)

(i) Synthesis of Compound (x)

204 g of 1,4-dihydroxy-2-naphthoic acid was dissolved in 500 ml of dimethyl formamide and thereto, 386 g of a 28% methanol solution of sodium methoxide was added. After 10 minute stirring, 300 ml of a dimethyl formamide solution containing 186 g of 2,4-dinitrofluorobenzene was added dropwise to this reaction mixture at room temperature. The stirring was continued for 2 hours and then, 101.4 g of concentrated hydrochloric acid was gradually added to the resulting reaction mixture to precipitate crystals. The crystals were filtered off, washed with water, and dried. Thus, 274 g of Compound (x) was obtained.

(2) Synthesis of Compound (xi)

To a mixture of 274 g of Compound (x), 226 g of o-tetra-decyloxyaniline and 2.5 liters of dimethyl formamide was added dropwise 400 ml of a chloroform solution containing 160.4 g of dicyclohexylcarbodiimide (DCC). After 4 hour stirring, the reaction solution was filtered. To the filtrate, 200 ml of water was added dropwise at a low speed. Crystals precipitated was filtered off, and dried. Thus, 292 g of Compound (xi) was obtained.

(3) Synthesis of Compound (27)

A mixture containing 500 g of reduced iron, 30 g of ammonium chloride, 30 ml of acetic acid, 350 ml of water and 2.5 liters of isopropyl alcohol was allowed to undergo reduction for 10 minutes. To this reaction mixture, 292 g of Compound (xi) was added slowly under refluxing. After 30 minutes, the reaction solution was filtered, and the filtrate was concentrated. The concentrate was dissolved in 1 liter of tetrahydrofuran and thereto, 78.5 g of benzenesulfonyl chloride was added dropwise at room temperature. Thereto, 35.1 g of pyridine was further added dropwise. Thereafter, the stirring was continued for 12 hours. The resulting solution was extracted with ethyl acetate, and the organic phase was washed with water. Further, the organic phase was dried over anhydrous sodium sulfate. Then, the solvent was distilled away, and the resulting concentrate was recrystallized from an acetonitrile-ethyl acetate mixture. Thus, 273.2 g of Compound (27) was obtained. (Melting Point 167.0° C.)

SYNTHESIS EXAMPLE 5

Synthesis of Compound (28)

Compound (28) was synthesized in the same manner as in Synthesis Example 4 except that methanesulfonyl chloride was employed in place of benzenesulfonyl chloride in the step (3) of Synthesis Example 4. (Melting Point 146.0° C.)

SYNTHESIS EXAMPLE 6

Synthesis of Compound (51)

Compound (51) was synthesized taking the following route.

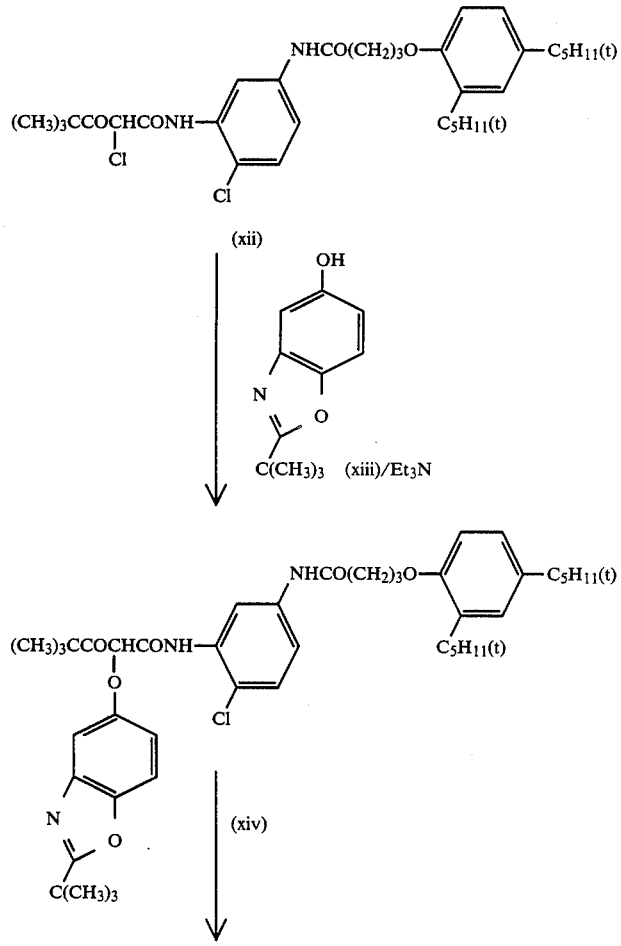

-continued

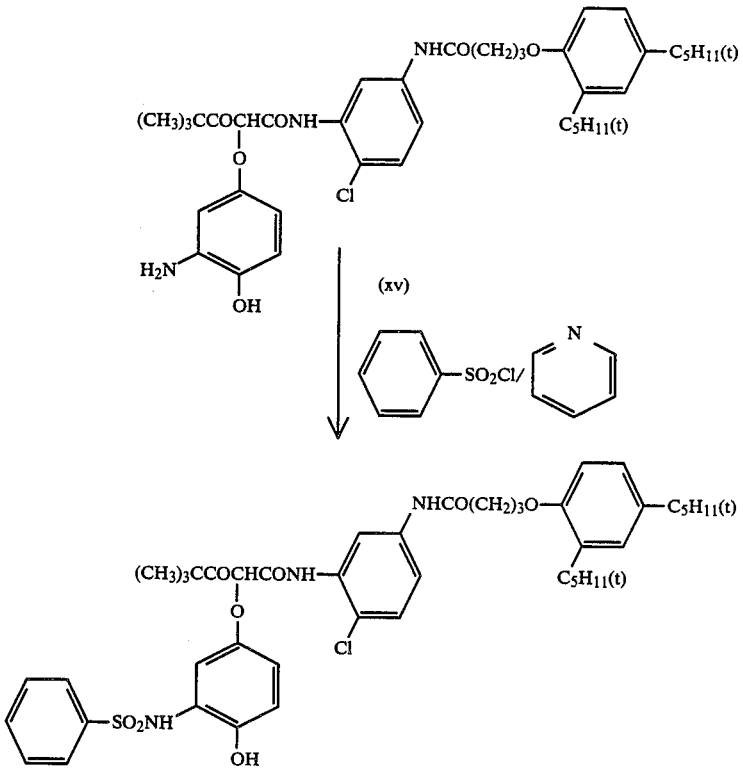

Compound (51)

(1) Synthesis of Compound (xiv)

30 g of Compound (xii), 10.4 g of Compound (xiii) and 6 g of triethylamine were added to 200 ml of acetonitrile, and refluxed for 5 hours under heating. After cooling to room temperature, 1 liter of ethyl acetate was added to the reaction mixture, and washed with water. The resulting solution was neutralized with dilute hydrochloric acid, and washed with water repeatedly. After the separation of the oily phase, it was concentrated, and the residue was recrystallized using a mixed solvent composed of ethyl acetate and hexane. Thus, 19.3 g of Compound (xiv) was obtained.

(2) Synthesis of Compound (xv)

19.3 g of Compound (xiv) was added to 200 ml of a 10% hydrous ethanol containing 8 g of potassium hydroxide, and stirred at room temperature for 5 hours. Thereto, 1 liter of ethyl acetate was added, washed with water, and neutralized with acetic acid. Therefrom, the oily phase was separated after the washing with water, and concentrated. The residue was crystallized using a mixed solvent composed of ethyl acetate and hexane. Thus, 12.6 g of Compound (xv) was obtained.

(3) Synthesis of Compound (51)

12.6 g of Compound (xv), 6 g of pyridine and 3.5 g of benzenesulfonyl chloride were added to 100 ml of chloroform, and refluxed under heating. After 3-hour refluxing, the reaction mixture was cooled, and washed successively with dilute hydrochloric acid and water. After the separation of the oily phase, the solvent was distilled away, and the residue was crystallized using a mixed solvent composed of ethyl acetate and hexane. Thus, 10.3 g of the desired coupler was obtained.

SYNTHESIS EXAMPLE 7

Synthesis of Compound (52)

Coupler (52) was synthesized in the same manner as in Synthesis Example 6 except that 6-hydroxy-2-tert-butylbenzoxazole was employed in place of Compound (xiii) in the step (1) of Synthesis Example 6.

SYNTHESIS EXAMPLE 8

Synthesis of Compound (53)

Compound (53) was synthesized taking the following route.

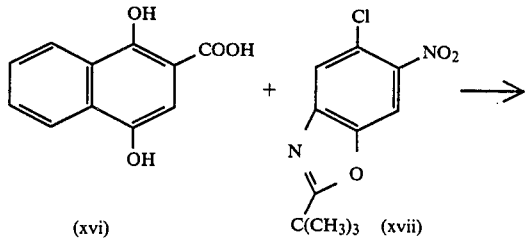

-continued

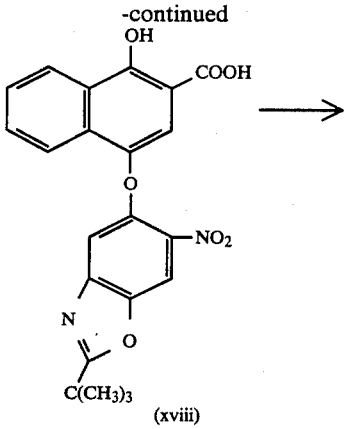

(xviii)

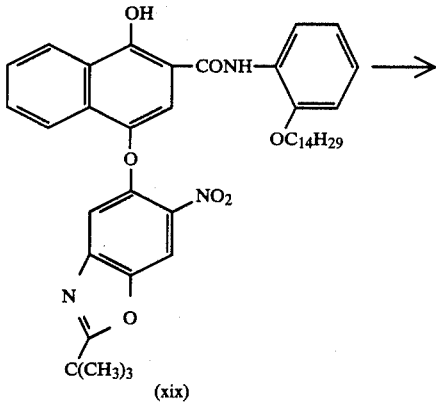

(xix)

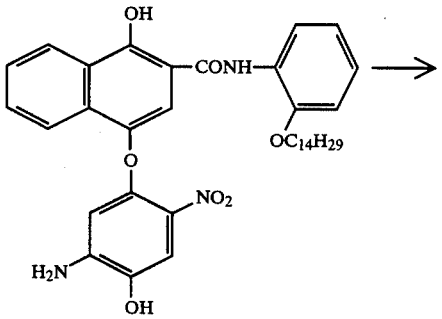

(xx)

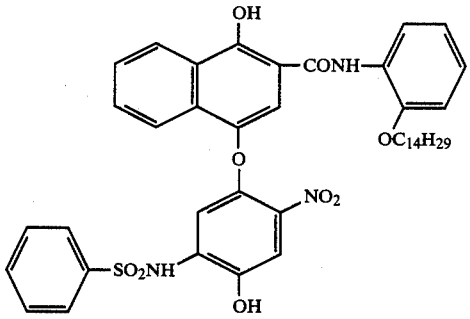

Compound (53)

(1) Synthesis of Compound (xviii)

41 g of Compound (xvi) and 22 g of sodium methoxide were added to 200 ml of N,N-dimethylformamide and thereto, 51.2 g of Compound (xvii) was further added to room temperature. The resulting mixture was heated up to 50° C., and the reaction was continued for 8 hours. Thereafter, the reaction product was post-treated in a conventional manner. Thus, 48 g of Compound (xviii) was obtained.

(2) Synthesis of Compound (xix)

The dehydrating condensation reaction was achieved using 48 g of Compound (xviii), 34.7 g of 2-tetradecyloxyaniline and 23.4 g of N,N'-dicyclohexylcarbodiimide to yield 50.2 g of Compound (xix).

(3) Synthesis of compound (xx)

50.2 g of Compound (xix) was hydrolized in 400 ml of methanol using 20 g of potassium hydroxide to yield 42.3 g of Compound (xx).

(4) Synthesis of Compound (53)

42.3 g of Compound (xx), 12.8 g of benzenesulfonyl chloride and 11.5 g of pyridine were refluxed in chloroform under heating to yield 28.3 g of Compound (53).

The couplers of the present invention and other couplers usable in combination therewith, which are described hereinafter, can be introduced into a photosensitive material using various kinds of known dispersion method. Typical examples of such methods include a solid dispersion method, an alkali dispersion method, a latex dispersion method, an oil-in-water dispersion method, and so on. Of these methods, a latex dispersion method is used to advantage, and an oil-in-water dispersion method is more advantageous. In an oil-in-water dispersion method, substances to be dispersed are firstly dissolved in a single solvent, i.e., either a high boiling point solvent having a boiling point of 175° C. or above or a so-called auxiliary solvent having a low boiling point, or in a mixture of both solvents, and then finely dispersed into water on an aqueous medium like an aqueous solution of gelatin in the presence of a surface active agent. Specific examples of high boiling point solvents are described in U.S. Pat. No. 2,322,027, and so on. The dispersion may be accompanied by phase inversion and the auxiliary solvent contained in the dispersion may optionally be removed or reduced by distillation, a noodle washing method, an ultrafiltration method, and so on before the coating step.

Specific examples of high boiling point solvents which can be used include phthalic acid esters (e.g., dibutyl phthalate, dicyclohexyl phthalate, di-2-ethylhexyl phthalate, didodecyl phthalate, etc.), phosphoric or phosphonic acid esters (e.g., triphenyl phosphate, tricresyl phosphate, 2-etylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate, etc.), benzoic acid esters (e.g., 2-ethylhexylbenzoate, dodecylbenzoate, 2-ethylhexyl-p-hydroxybenzoate, etc.), amides (e.g., diethyldodecaneamide, N-tetradecylpyrrolidone, etc.), alcohols or phenols (e.g., isostearyl alcohol, 2,4-di-tert-amylphenol, etc.), aliphatic carbonic acid esters (e.g., dioctyl azalate, glycerol tributyrate, isostearyl lactate, trioctylcitrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), and so on. Auxiliary solvents which can be used are those having a boiling point ranging from about 30° C. to about 160° C., and typical examples thereof include ethyl acetate, butyl acetate, ethyl propionate, methyl ethyl ketone, cyclohexanone, 2-ethoxyethyl acetate, dimethyl formamide, and so on.

Steps and effects of a latex dispersion method, and specific examples of latexes usable as impregnant in the dispersion method are described in U.S. Pat. No. 4,199,365, German Patent Applications (OLS) Nos. 2,541,274 and 2,541,230, and so on.

Various kinds of color couplers, in addition to the couplers of the present invention, can be used in the practice of the present invention. The term color couplers used herein refers to the compounds capable of producing dyes by reacting with oxidation products of aromatic primary amine developing agents. Typical examples of useful color couplers include naphthol or phenol compounds, pyrazolone or pyrazoloazole compound, and open-chain or heterocyclic ketomethylene compounds. Specific examples of cyan, magenta and yellow couplers which can be used in the present invention are described in patent specifications cited in *Research Disclosure* (hereafter "RD"), RD No. 17643, VII-D (December, 1978), and RD No. 18717 (November, 1979).

In using color couplers in a condition that they are incorporated in a photosensitive material, it is desired that they should be nondiffusible by containing a ballast group or having a polymeric structure. Two-equivalent couplers having an eliminable group at the coupling active site in place of a hydrogen atom are preferable to four-equivalent couplers having a hydrogen atom at the coupling active site. In addition, couplers of the kind which can produce dyes having moderate diffusibility through color development, colorless couplers, couplers capable of releasing a development inhibitor upon development (so-called DIR couplers), or couplers capable of releasing a development accelerator can be employed.

Typical representative yellow couplers which can be used in the present invention are oil protected acylacetoamide couplers. Specific examples thereof are described in U.S. Pat. Nos. 2,407,210, 2,875,057 and 3,265,506, and so on. In the present invention, it is preferable to use two-equivalent yellow couplers. Typical examples thereof include yellow couplers of oxygen atom splitting-off type described in U.S. Pat. Nos. 3,408,194, 3,447,928, 3,933,501 and 4,022,620, and so on; and yellow couplers of nitrogen atom splitting-off type described in Japanese Patent Publication No. 10739/83, U.S. Pat. Nos. 4,401,752 and 4,326,024, RD No. 18053 (April, 1979), British Pat. No. 1,425,020, German Patent Applications (OLS) Nos. 2,219,917, 2,261,361, 2,329,587 and 2,433,812, and so on. α-Pivaloylacetoanilide couplers can produce dyes excellent in fastness, especially in light fastness, upon color development. On the other hand, α-benzoylacetoanilide couplers can provide high color density of the developed image.

Magenta couplers which can be used in the present invention are oil protected indazolone or cyanoacetyl couplers, preferably pyrazoloazole couplers such as those of 5-pyrazolone type, pyrazolotriazole type, and the like. Of 5-pyrazolone couplers, those which are substituted by an arylamino or acylamino group at the 3-position are more desirable from the viewpoints of hue and color density of the developed image, and the representatives thereof are described in U.S. Pat. Nos. 2,311,082, 2,343,703, 2,600,788, 2,908,573, 3,062,653, 3,152,896 and 3,936,015, and so on. Further, two-equivalent 5-pyrazolone couplers are preferred because they can bring about high color density of the developed image and high photographic speed even when the silver coverage is reduced. In particular, those containing an eliminable group of the nitrogen atom splitting-off type described in U.S. Pat. No. 4,310,619 and those containing as an eliminable group an arylthio group described in U.S. Pat. No. 4,351,897 can be used to advantage. Also, the ballast groups described in European Pat. No. 73,636 have a developed color density-increasing effect on the 5-pyrazolone couplers. Examples of pyrazoloazole couplers include pyrazolobenzimidazoles described in U.S. Pat. No. 3,369,897, preferably pyrazolo[5,1-c][1,2,4]triazoles described in U.S. Pat. No. 3,725,067, pyrazolotetrazoles described in RD No. 24220 (June, 1984), and pyrazolopyrazoles described in RD No. 24230 (June, 1984). From the viewpoints that the developed dyes have little side-absorption in the yellow region and great fastness to light, imidazo[1,2-b]pyrazoles described in European Pat. No. 119,741 are preferred, and pyrazolo[1,5-b][1,2,4]triazoles described in European Pat. No. 119,860 are particularly preferred.

Cyan couplers which can be used in the present invention include those of the oil-protected naphthol and phenol types Representatives of naphthol couplers are those described in U.S. Pat. No. 2,474,293, and preferable two-equivalent naphthol couplers of the oxygen atom splitting-off type are described in U.S. Pat. Nos. 4,052,212, 4,146,396, 4,228,233 and 4,296,200. Specific examples of phenol couplers are described in U.S. Pat. Nos. 2,369,929, 2,801,171, 2,772,162, 2,895,826, and so on. Cyan couplers fast to moisture and heat are used to advantage in the present invention, and typical examples thereof include phenol type cyan couplers described in U.S. Pat. No. 3,772,002, 2,5-diacylamino substituted phenol type couplers described in U.S. Pat. Nos. 2,772,162, 3,758,308, 4,126,396, 4,334,011 and 4,327,173, German Patent Application (OLS) No. 3,329,729, Japanese Patent Application No. 42671/83, and so on, and phenol couplers which have a phenylureido group at the 2-position and an acylamino group at the 5-position, as described in U.S. Pat. Nos. 3,446,622, 4,333,999, 4,451,559, and 4,427,767, and so on.

The couplers of the present invention and couplers as described above may be incorporated in the same layer as a combination of two or more thereof for the purpose of satisfying characteristics required of the photosensitive material. Of course, the same coupler may be added to two or more different layers.

In order to correct unnecessary absorption which developed dyes of magenta and cyan couplers show in shorter wave length regions, combined use with colored couplers is desirable in color photosensitive materials for photographic use. Typical examples of such couplers include yellow-colored magenta couplers described in U.S. Pat. No. 4,163,670, Japanese Patent Publication No. 39413/82, etc.; magenta-colored cyan couplers described in U.S. Pat. Nos. 4,004,929 and 4,138,258, British Pat. No. 1,146,368, etc.; and so on.

These color couplers may form a polymer including a dimer. Typical examples of polymeric couplers are described in U.S. Pat. Nos. 3,451,820 and 4,080,211. Specific examples of polymeric magenta couplers are described in British Pat. No. 2,102,173 and U.S. Pat. No. 4,367,282.

The combined use with couplers of the kind which can produce diffusible dyes upon color development can effect an improvement in granularity of developed images. Specific examples of magenta couplers of the above-described type are described in U.S. Pat. No. 4,366,237 and British Pat. No. 2,125,570, and those of yellow, magenta and cyan couplers of the above-described type are described in European Pat. No. 96,873 and German Patent Application (OLS) No. 3,324,533.

Dye forming couplers are used in an amount of from 0.002 to 0.5 mol per mol of light-sensitive silver halide present in the layer in which they are to be incorporated. In typical color photosensitive materials for photographic use, yellow, magenta, and cyan couplers are used in amounts of from 0.01 to 0.5 mol, from 0.003 to 0.25 mol and from 0.002 to 0.12 mol, respectively, per mol of light-sensitive silver halide. On the other hand, in many of color photosensitive materials for printing use, such as color paper, etc., each of yellow, magenta and cyan couplers is used in an amount of from 0.1 to 0.5 mol per mol of light-sensitive silver halide. Of course, it is possible to design photosensitive materials beyond the above-described ranges.

Gelatin is employed to advantage as a binder or a protective colloid to constitute emulsion layers and interlayers of the photosensitive material of the present invention. Hydrophilic colloids other than gelatin can also be used independently or in combination with gelatin.

Silver halides usable in photographic emulsion layers of the photosensitive material of the present invention include silver bromide, silver iodobromide, silver iodochlorobromide, silver chlorobromide and silver chloride. Preferred silver halides are silver iodobromides containing 15 mol% or less of silver iodide. Particularly preferred silver halides are silver iodobromides containing from 2 to 12 mol% of silver iodide.

The silver halide grains in the photographic emulsions may have a regular crystal form, such as that of a cube, an octahedron, a tetradecahedron, and so on; an irregular crystal form, such as that of a sphere, and so on; or a composite form thereof. In addition, tabular grains having a thickness of 0.5 μm or less, a diameter of at least 0.6 μm, and a mean aspect ratio of 5 or more may be contained in a photographic emulsion in a fraction of 50 mol% or more, based on the total projected area of all grains present therein.

A crystal form of the silver halide grains may be uniform throughout, or the interior and the surface of the silver halide grains may differ in crystal form. The silver halide grains may have a layer structure, or silver halide grains having different halide compositions may be fused together by an epitaxial junction. A mixture of various crystal forms of silver halide grains may also be present in a photographic emulsion.

In addition, either silver halide grains of the kind which form latent images predominantly at the surface of the grains, or grains of the kind which mainly form latent images inside the grains may be used.

Either fine silver halide grains having diameters of 0.1 micron or less, based on projection area, or coarse ones having diameters up to 3 microns, based on projection area, may be employed, and either a monodisperse emulsion having a narrow size distribution or a polydisperse emulsion having a broad size distribution may be used.

The photographic emulsions employed in the present invention can be prepared using various methods, as described, for example, in P. Glafkides, *Chimie et Phisique Photographique,* Paul Montel, Paris (1967), G. F. Duffin, *Photographic Emulsion Chemistry,* The Focal Press, London (1966), V. L. Zelikmann et al, *Making and Coating Photographic Emulsion,* The Focal Press, London (1964), and so on. More specifically, the acid process, the neutral process, the ammonia process and so on can be employed, and suitable methods for reacting a water-soluble silver salt with a water-soluble halide include a single jet method, a double jet method and a combination thereof.

A method in which silver halide grains are produced in the presence of excess silver ion (the so-called reversal mixing method) can also be employed. On the other hand, the so-called controlled double jet method, in which the pAg is maintained constant, can also be employed in the present invention. According to this method, silver halide emulsions having a regular crystal form and an almost uniform grain size can be obtained.

Two or more of silver halide emulsions prepared separately may be used as a mixture thereof.

In a process for forming silver halide grains or allowing the formed grains to ripen physically, cadmium salts, zinc salts, lead salts, thallium salts, iridium salts or complexes, rhodium salts or complexes, iron salts or complexes, and/or so on may be present.

The silver halide emulsions are usually chemically sensitized. Chemical sensitization can be carried out using processes described in H. Frieser, *Die Grundlagen der Photographischen Prozesse mit Silberhalogeniden,* pp. 675–734, Akademische Verlagsgesellschaft (1968), and so on.

More specifically, sulfur sensitization using compounds contaning sulfur capable of reacting with silver ion or active gelatin (e.g., thiosulfates, thioureas, mercapto compounds, rhodanines and so on), reduction sensitization using reducing materials (e.g., stannous salts, amines, hydrazine derivativesm formamidine sulfinic acid, silane compounds and so on), sensitization with noble metal compounds (e.g., gold metal complexes, and Group VIII metal complexes such as those of platinum, iridium, palladium, etc.), and so on can be employed individually or as a combination thereof.

The photographic emulsions of the present invention can contain a wide variety of compounds for purposes of preventing fog or stabilizing photographic functions during production, storage, or photographci processing, with specific examples including azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole), and so on; mercaptopyrimidines; mercaptotriazines; thioketo compounds like oxazolidinethiones; azaindenes such as triazaindenes, tetraazaindenes (especially 4-hydroxy substituted (1,3,3a,7) -tetraazaindenes), pentaazaindenes, and so on; and compounds which have been known as antifoggants or stabilizers, such as benzenethiosulfonic acid, benzenesulfinic acid, benzenesulfonic acid amide, and so on.

The photographic emulsion layers of the photographic material of the present invention may contain, for example, polyalkylene oxides and derivatives thereof, such as ethers, esters and amines thereof, thioether compounds. thiomorpholines, quaternary ammonium salt compounds, urethane derivatives, urea derivatives, imidazole derivatives, 3-pyrazolidones and so on in order to increase the photographic speed and the contrast, or in order to accelerate the developing rate.

The photographic emulsion layers and other hydrophilic colloid layers to constitute the photographic material of the present invention can contain a dispersion of water insoluble or slightly soluble synthetic polymers for the purpose of improvements in dimensional stability and so on.

The photographic emulsions to be used in the present invention may be spectrally sensitized using methine dyes or other dyes. Specific spectral sensitizing dyes which can be employed include cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes and complex merocyanine dyes. Any nuclei usually present in cyanine dyes can be the basic heterocyclic nuclei of these dyes.

These sensitizing dyes may be employed individually or in combination. Combinations of sensitizing dyes are often employed for the purpose of supersensitization.

Substances which can exhibit a supersensitizing effect in a combination with a certain sensitizing dyes although they themselves do not spectrally sensitize silver halide emulsions or do not absorb light in the visible region may be incorporated into the silver halide emulsions. For example, aminostyryl compounds substituted with nitrogen-containing heterocyclic groups (for instance, as described in U.S. Pat. Nos. 2,933,390 and 3,653,721), aromatic organic acid-formaldehyde condensates (for instance, as described in U.S. Pat. No. 3,743,510), cadmium salts, azaindene compounds and so on can be employed.

The present invention can also be applied to a multilayer multicolor photographic material having at least two different color sensitivities on a support. A multilayer color photographic material has, in general, at least one red-sensitive emulsion layer, at least one green-sensitive layer and at least one blue-sensitive layer on a support. The order of these layers can be varied as desired. Usually cyan-, magenta- and yellow-forming couplers are incorporated in red-, green- and blue-sensitive emulsion layers, respectively. However, different combinations can be employed, if desired.

The photographic emulsion layers or other hydrophilic colloid layers which constitute the photographic material of the present invention may contain inorganic or organic hardeners. Examples of hardeners which can be used include active vinyl compounds (e.g., 1,3,5-triacryloyl-hexahydro-s-triazine, 1,3-vinylsulfonyl-2-propanol, etc.), active halogen containing compounds (e.g., 2,4-dichloro-6-hydroxy-s-triazine, etc.), halogeno carboxyaldehydes such as mucochloric acid, mucophenoxychloric acid, etc.), and so on. These hardeners may be used alone or as a combination of two or more thereof.

The photographic material prepared in accordance with the present invention may contain as a color fog inhibitor a hydroquinone derivative, an aminophenol derivative, a gallic acid derivative, an ascorbic acid derivative and so on.

Hydrophilic colloid layers of the photographic material prepared in accordance with the present invention may contain an ultraviolet absorbing agent. For examples, aryl-substituted benzotriazole compounds (e.g., those described in U.S. Pat. Nos. 3,533,794 and 4,236,013, Japanese Patent Publication No. 6540/76, European Pat. No. 57,160, etc.), butadiene compounds (e.g., those described in U.S. Pat. Nos. 4,045,229 and 4,195,999), cinnamate compounds (e.g., those described in U.S. Pat. Nos. 3,705,805 and 3,707,375), benzophenones (e.g., those described in U.S. Pat. No. 3,215,530 and British Pat. No. 1,321,355) and polymers containing ultraviolet absorbing residues (e.g., those described in U.S. Pat. Nos. 3,761,272 and 4,431,726) may be used. Also, ultraviolet absorbing brightening agents described in U.S. Pat. Nos. 3,499,762 and 3,700,455 may be employed. Typical examples of ultraviolet absorbing agents are described in RD No. 24239 (June, 1984) and so on.

The photographic material prepared in accordance with the present invention may contain water-soluble dyes as filter dyes, anti-halation dyes or dyes for various other purposes in its hydrophilic colloid layers. Examples of dyes useful for the above-described purposes include oxonol dyes, hemioxonol dyes, styryl dyes, merocyanine dyes, cyanine dyes, and azo dyes. Of these dyes, oxonol dyes, hemioxonol dyes, and merocyanine dyes are used to greater advantage.

In the present invention, known discoloration inhibitors can be used. Color image stabilizers which can be used in the present invention can be used alone or in combinations of two or more thereof. Specific examples of known discoloration inhibitors include hydroquinone derivatives, gallic acid derivatives, p-alkoxyphenols, p-oxyphenol derivatives, and bisphenols.

Color photographic emulsion layers which comprise the dye image forming layers constituted in accordance with the present invention are coated on a conventionally used flexible support, such as plastic films, paper, cloth or the like. Suitable examples of flexible supports include films made of semi-synthetic or synthetic polymers such as cellulose acetate, cellulose acetate butyrate, polystyrene, polyethylene terephthalate, polycarbonate and so on, paper coated or laminated with a baryta layer or an $\alpha$-olefin polymer (e.g., polyethylene, polypropylene, etc.), and so on. Such a support may be colored with dyes or pigments. Also, it may be rendered black for the purpose of screening light.

When a support is used for a reflection type photographic material, it is desirable to incorporate white pigments into the support or a laminated layer. Suitable examples of white pigments include titanium dioxide, barium sulfate, zinc oxide, zinc sulfate, calcium carbonate, antimony trioxide, silica white, alumina white, titanium phosphate, and so on. Of these pigments, titanium dioxide, barium sulfate, and zinc oxide are particularly useful.

Surfaces of these supports are generally submitted to a subbing treatment in order to increase adhesiveness to photographic emulsion layers and so on. After or before the subbing treatment, the support surface may be subjected to corona discharge, irradiation with ultraviolet light, flame treatment and so on.

When these supports are used in reflection type photographic materials, a hydrophilic colloid layer containing a white pigment in high density may be provided between the support and an emulsion layer. Thereby, whiteness and sharpness of the photographic image can be enhanced.

In many of reflection type photographic materials containing magenta couplers of the present invention, a polymer laminated paper sheet is used as support. However, it is particularly preferred to employ a synthetic resin film into which a white pigment is kneaded in advance, because photographic images which are not only improved in smoothness, glossiness and sharpness but also excellent in saturation and depiction capability in dark areas can be obtained. In this case, a suitable raw material for the synthetic resin film is polyethylene terephthalate or cellulose acetate, and a white pigment which is used to particular advantage in kneading with such a raw material as described above is barium sulfate or titanium oxide.

The color photographic materials produced in accordance with the present invention can contain various photographic additives known in this art in addition to the above-described agents. For example, stabilizers, antifoggants, surface active agents, antistatic agents, developing agents and so on can be added as occasion calls. Specific examples of these additives are described in RD No. 17643 (December 1978).

Moreover, a fine-grained silver halide emulsion which has substantially no sensitivity to light (for example, silver chloride, silver bromide or silver chlorobromide emulsion having a mean grain size of 0.20 micron or less) may optionally be added to light-sensitive silver halide emulsion layers or other hydrophilic colloid layers.

A color developing solution which can be used in the present invention is an alkaline aqueous solution containing preferably an aromatic primary amine color developing agents as a main component. Typical examples of color developing agents of the above-described type include 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfoamidoethylaniline, 4-amino-3-methyl-N-ethyl-N-$\beta$-methoxyethylaniline, and the like.

Besides color developing agents as described above, the color developing solution can contain a pH buffering agent such as sulfites, carbonates, borates and phosphates of alkali metals, a development inhibitor or an antifoggant such as bromides, iodides and organic antifoggants, and so on. Optionally, a water softener, a preservative such as a hydroxyamine, etc., an organic solvent such as benzyl alcohol, diethylene glycol, etc., a development accelerator such as polyethylene glycols, quaternary ammonium salts, amines, etc., dye-forming couplers, competing couplers, a fogging agent such as sodium borohydride, etc., an auxiliary developer such as 1-phenyl-3-pyrazolidone, etc., a viscosity imparting agent, chelating agents of polycarboxylic acid type described in U.S. Pat. No. 4,083,723, an antioxidant described in German Patent Application (OLS) No. 2,622,950, and so on may be contained in the color developing solution.

The photographic emulsion layers which have been color development-processed are generally subjected to a bleach processing. The bleach processing may be carried out either simultaneously with or separately from a fix processing. Suitable examples of bleaching agents which can be used include compounds of polyvalent metals such as iron(III), cobalt(IV), chromium(VI), copper(II), etc., peroxy acids, quinones, nitroso compounds, and so on.

More specifically, ferricyanides, dichromates, organic complex salts of Fe(III) or Co(III) such as complex salts of aminopolycarboxylic acids, e.g., ethylenediaminetetraacetic acid, nitrilotriacetic acid, 1,3-diamino-2-propanoltetraacetic acid, etc., or those of organic acids, e.g., citric acid, tartaric acid, malic acid, etc., persulfates, permanganates, nitrosophenol, and so on, can be employed as bleaching agent. Of these compounds, potassium ferricyanide, sodium ethylenediaminetetraacetatoferrate(III), and ammonium ethylenediaminetetraacetatoferrate(III) are especially useful. In particular, (ethylenediaminetetraacetato)iron(III) complexes are used to advantage in both an independent bleaching bath and a combined bleaching and fixing bath.

After the color development or the bleach-fix processing, the photosensitive material may be washed with water. The color development is generally carried out in a temperature range of from about 18° C. to about 55° C., preferably at 30° C. or higher, and particularly preferably at 35° C. or higher. The time required for color development is generally in the range of from about 3.5 minutes to about 1 − minute, and a short developing time is preferable to long one within this range. In the continuous development processing, it is desired that a replenisher should be supplemented. A suitable amount of the replenisher ranges from 330 ml to 160 ml, preferably 100 ml or less, per square meter of the processed area. A suitable content of benzyl alcohol in the developing solution is generally 20 ml/l or less, and preferably 10 ml/l or less. The bleach-fix processing can be effected at a temperature ranging from about 18° C. to about 50° C., preferably not lower than 30° C. When the processing temperature is set at 35° C. or above, the processing time can be reduced to 1 minute or less and that, the amount of the replenisher can be diminished. The time required for the washing step after the color development or the bleach-fix processing is generally 3 minutes or less, and it can also be reduced to 1 minute or less if a stabilizing bath is used in combination therewith.

The developed dyes are deteriorated not only by exposure to light, heat or moisture but also by the growth of mold upon storage to undergo discoloration. In particular, cyan dye images are subjected to greate deterioration due to mold. Therefore, it is desired that an antimold agent should be used. Suitable examples of antimold agents include 2-thiazolylbenzimidazoles, as described in Japanese patent Application (OPI) No. 157244/82. The antimold agent may be incorporated in the photographic material or added externally in the process of development, that is, it can be incorporated into the photographic material in an arbitrary process, provided that it is present in the processed material.

The present invention can be applied to silver halide color photosensitive materials for general use, for example, color negative films, color papers, color positive films, color reversal slide films, color reversal motion picture films, color reversal TV films and so on. In particular, the present invention can have remarkable effects on improvements in sharpness and granularity when utilized in color negative films in which high photographic speed and high image quality are required, and particularly in color reversal films.

The present invention can be applied to both the black color-forming coupler process and the three-color process. Detailed descriptions of the black color-forming coupler process are described in U.S. Pat. Nos. 3,622,629, 3,734,735, and 4,126,461, and Japanese Patent Applications (OPI) Nos. 105247/80, 42725/77, and 105248/80. On the other hand, the three-color process is described in detail, for example, in RD No. 1712 (July, 1978).

EXAMPLE 1

On a cellulose triacetate film support having thereon a subbing layer, were coated the emulsion layers and auxiliary layers described below in the order listed to prepare Sample (1).

(1) Low-speed, Red-sensitive Emulsion Layer 100 g of 2-(heptafluorobutylamido)-5-[2'-(2'',4''-di-t-amylphenoxy)butylamido]phenol (Coupler(1)), which functions as cyan coupler, was dissolved in a mixed solvent composed of 100 ml of tricresyl phosphate and 100 ml of ethyl acetate, and mixed with 1 kg of a 10% aqueous solution of gelatin and 10 g of sodium dodecylbenzenesulfonate (surface active agent) under high speed stirring to prepare an emulsion. To a 500 g portion of the emulsion were added 1 kg of a red-sensitive, low speed, silver iodobromide emulsion (having a mean grain size of 0.3 micron and a silver iodide content of 3 mol%, and containing 70 g of silver and 60 g of gelatin), gelatin, water, a stabilizer, a coating aid and so on. The resulting emulsion was coated in a layer having a dry thickness of 2 microns (silver coverage: 0.6 g/m$^2$).

(2) Medium-Speed, Red-sensitive Emulsion Layer

A 1 kg portion of the same cyan coupler emulsion as used in the first layer was admixed with 1 kg of a red-sensitive, medium-speed, silver iodobromide emulsion (having a mean grain size of 0.5 micron and a silver iodide content of 3 mol%, and containing 70 g of silver and 60 g of gelatin), gelatin, water, a stabilizer, a coating aid and so on. The resulting emulsion was coated so as to have a dry thickness of 1 micron (silver coverage: 0.4 g/m$^2$).

(3) High-speed, Red-sensitive Emulsion Layer

A 1 kg portion of the same coupler emulsion as used in the first layer was admixed with 1 kg of a red-sensitive, high speed, silver iodobromide emulsion (having a mean grain size of 0.6 micron and a silver iodide content of 3 mol%, and containing 70 g of silver and 60 g of gelatin), gelatin, water, a stabilizer, a coating aid and so on. The resulting emulsion was coated in a layer having a dry thickness of 1 micron (silver coverage: 0.4 g/m$^2$).

(4) Interlayer

An emulsion prepared by dissolving 200 g of 2,5-di-secoctylhydroquinone in 200 ml of ethyl acetate, and mixing the solution with 1 kg of a 10% aqueous solution of gelatin and 20 g of sodium dodecylbenzenesulfonate under high speed stirring was mixed with gelatin, water, a coating aid and so on. The resulting emulsion was coated in a layer having a dry thickness of 1 micron.

(5) Low-speed, Green-sensitive Emulsion Layer

An emulsion was prepared in the same manner as the emulsion of the first layer except that the magenta coupler, 1-(2,4,6-trichlorophenyl)-3-[3-(2,4-di-tert-amylphenoxyacetoamido)benzamido]-5-pyrazolone was employed in place of the cyan coupler. A 500 g portion of this emulsion was admixed with 1 kg of a green-sensitive, low-speed, silver iodobromide emulsion (having a mean grain size of 0.3 micron and a silver iodide content of 3 mol%, and containing 70 g of silver and 60 g of gelatin), gelatin, water, a stabilizer and a coating aid. The resulting emulsion was coated in a layer having a dry thickness of 2 microns (silver coverage: 0.7 g/m$^2$).

(6) Medium-speed, Green-sensitive Emulsion layer

A 1 kg portion of the same magenta coupler emulsion as used in the fifth layer was admixed with 1 kg of a green-sensitive, medium-speed, silver iodobromide emulsion (having a mean grain size of 0.5 micron and a silver iodide content of 3 mol%, and containing 70 g of silver and 60 g of gelatin), gelatin, water, a stabilizer, a coating aid and so on. The resulting emulsion was coated in a layer having a dry thickness of 1 micron (silver coverage: 0.4 g/m$^2$).

(7) High-speed, Green-sensitive Emulsion Layer

A 1 kg portion of the same magenta coupler emulsion as used in the fifth layer was admixed with 1 kg of a green-sensitive, high-speed, silver iodobromide emulsion (having a mean grain size of 0.7 micron and a silver iodide content of 3 mole%, and containing 70 g of silver and 60 g of gelatin), gelatin, water, a stabilizer, a coating aid and so on. The resulting emulsion was coated in a layer having a dry thickness of 1 micron (silver coverage: 0.4 g/m$^2$).

(8) Interlayer

A 1 kg portion of the same emulsion as used in the fourth layer, gelatin, water and a coating aid were mixed, and coated in a layer having a dry thickness of 0.5 micron.

(9) Yellow Filter Layer

Yellow colloidal silver and gelatin were mixed, and coated in a layer having a dry thickness of 1 micron.

(10) Low-speed, Blue-sensitive Emulsion layer

An emulsion was prepared in the same manner as the emulsion used in the first layer except that the yellow coupler, α-(pivaloyl)-α-(1-benzyl-5-ethoxy-3-hydantoinyl)-2-chloro-5-dodecyloxycarbonylacetoanilide, was employed in place of the cyan coupler, and both the amount of tricresyl phosphate and that of ethyl acetate were changed to 120 ml. A 1 kg portion of this emulsion was admixed with 1 kg of a blue-sensitive, low-speed, silver iodobromide emulsion (having a mean grain size of 0.5 micron and a silver iodide content of 3 mol%, and containing 70 g of silver and 60 g of gelatin), gelatin, water, a stabilizer and a coating aid. The resulting emulsion was coated in a layer having a dry thickness of 2 microns (silver coverage: 0.6 g/m$^2$).

(11) Medium-speed, Blue-sensitive Emulsion Layer

A 1 kg portion of the same yellow coupler emulsion as used in the tenth layer was admixed with 1 kg of a medium-speed, blue-sensitive, silver iodobromide emulsion (having a mean grain size of 0.6 micron and a silver iodide content of 3 mol%, and containing 70 g of silver and 60 g of gelatin), gelatin, water, a stabilizer, a coating aid and so on. The resulting emulsion was coated in a layer having a dry thickness of 1 micron (silver coverage: 0.4 g/m$^2$).

(12) High-speed, Blue-sensitive Emulsion Layer

A 1 kg portion of the same yellow coupler emulsion as used in the tenth layer was admixed with 1 kg of a high-speed, blue-sensitive, silver iodobromide emulsion (having a mean grain size of 0.7 micron and a silver iodide content of 3 mol%, and containing 70 g of silver and 60 g of gelatin), gelatin, water, a stabilizer, a coating aid and so on. The resulting emulsion was coated in a layer having a dry thickness of 1 micron (silver coverage: 0.4 g/m$^2$).

(13) Second Protective Layer

UV absorbents, 15 g of 5-chloro-2-(2-hydroxy-3,5-di-t-butylphenyl)-2H-benzotriazole, 30 g of 2-(2-hydroxy-5-t-butylphenyl)-2H-abenzotriazole, 35 g of 2-(2-hydroxy-3-sec-butyl-5-tert-butylphenyl)-2H-benzotriazole and 100 g of dodecyl-5-(N,N-diethylamino)-2-benzenesulfonyl-2,4-pentadienoate, were dissolved in a mixed solvent composed of 200 m of tricresyl phosphate and 200 ml of ethyl acetate, and mixed with 20 g of sodium dodecylbenzenesulfonate and 2 kg of a 10% aqueous solution of gelatin under high speed stirring to prepare an emulsion. A 1 kg portion of this emulsion was mixed with gelatin, water, a coating aid and so on, and coated in a layer having a dry thickness of 2 microns (total coverage of UV absorbents: 0.5 g/m$^2$).

(14) First Protective Layer

A chemically unsensitized fine-grained silver iodobromide emulsion (having a mean grain size of 0.1 micron and a silver iodide content of 1 mol%, and containing 70 g of silver and 60 g of gelatin) was mixed with gelatin, water, a stabilizer, a coating aid and so on, and coated in a layer having a dry thickness of 1 micron (silver coverage: 0.3 g/m$^2$).

The thus obtained multilayer film was designated as Sample (1).

Similarly, other cyan coupler emulsions were prepared exchanging one half the amount of the cyan coupler employed in the first to third layers for the compounds of the present invention or the comparison compounds (in equimolar amounts) listed in the following table, respectively. Samples (2) to (26) were prepared using these emulsions, respectively, in the same manner as employed in the preparation of Sample (1).

TABLE 1

| Sample | Cyan Coupler in First to Third Layer | | | Remark |
|---|---|---|---|---|
| (1) | Coupler (1) 100 g | | | Comparison |
| (2) | Coupler (1) 50 g + | Compound (1) | 62.5 g | Invention |
| (3) | Coupler (1) 50 g + | Compound (2) | 58.0 g | (containing |
| (4) | Coupler (1) 50 g + | Compound (3) | 62.2 g | Compound |
| (5) | Coupler (1) 50 g + | Compound (6) | 42.1 g | represented |
| (6) | Coupler (1) 50 g + | Compound (7) | 46.9 g | by Formula |
| (7) | Coupler (1) 50 g + | Compound (8) | 48.0 g | (Ia)) |
| (8) | Coupler (1) 50 g + | Compound (11) | 63.3 g | |
| (9) | Coupler (1) 50 g + | Compound (27) | 70.8 g | Invention |
| (10) | Coupler (1) 50 g + | Compound (28) | 60.9 g | (containing |
| (11) | Coupler (1) 50 g + | Compound (29) | 57.6 g | Compound |
| (12) | Coupler (1) 50 g + | Compound (30) | 56.7 g | represented |
| (13) | Coupler (1) 50 g + | Compound (31) | 63.4 g | by Formula |
| (14) | Coupler (1) 50 g + | Compound (32) | 65.4 g | (Ib)) |
| (15) | Coupler (1) 50 g + | Compound (33) | 82.3 g | |
| (16) | Coupler (1) 50 g + | Compound (53) | 63.0 g | Invention |
| (17) | Coupler (1) 50 g + | Compound (54) | 70.1 g | (containing |
| (18) | Coupler (1) 50 g + | Compound (55) | 56.5 g | Compound |
| (19) | Coupler (1) 50 g + | Compound (57) | 73.4 g | represented |
| (20) | Coupler (1) 50 g + | Compound (58) | 79.5 g | by Formula |
| (21) | Coupler (1) 50 g + | Compound (59) | 61.5 g | (Ic)) |
| (22) | Coupler (1) 50 g + | Compound (60) | 66.8 g | |
| (23) | Coupler (1) 50 g + | Comparison Compound (1) | 65.5 g | Comparison |
| (24) | Coupler (1) 50 g + | Comparison Compound (2) | 50.2 g | Comparison |
| (25) | Coupler (1) 50 g + | Comparison Compound (3) | 57.7 g | Comparison |
| (26) | Coupler (1) 50 g + | Comparison Compound (4) | 46.9 g | Comparison |

Comparaison Compound (1)

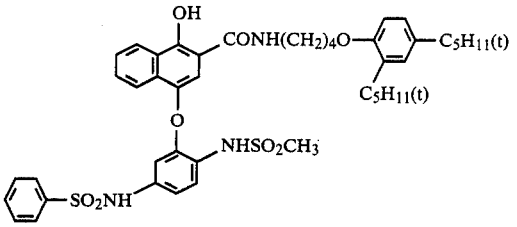

Comparison Compound (2)

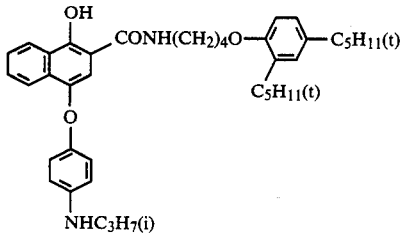

Comparison Compound (3)

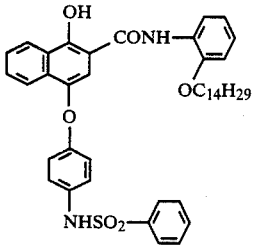

Comparison Compound (4)

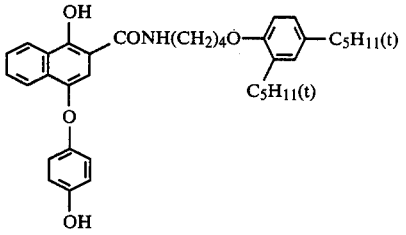

(Comparison compounds (2) and (4) are disclosed in Japanese Patent Application (OPI) No. 138636/82).

Each of Samples (1) to (26) was exposed to light through a pattern for granularity measurement, and subjected to color reversal processing. The thus processed samples were examined for R.M.S. granularity through the density measurement using a microdensitometer, according to *Photographic Science and Engineering*, vol. 19, p. 235 (1975). Granularities at the image densities of 1.0 and 2.0, respectively, are shown in Table 2.

Separately, each of Samples (1) to (26) was exposed to light through a pattern for MTF measurement, and submitted to the color reversal processing. The thus processed samples were measured with a microdensitometer, and MTF values of these samples were calculated. The "MTF value" is described in *Theory of the Photographic Process*, 4th edition, p. 604, Macmillan Publishing Co., Inc. (1977). Sharpness was represented by MTF value of 10 line/mm and 20 line/mm.

TABLE 2

| Sample | R.M.S. Granularity* Density 1.0 | R.M.S. Granularity* Density 2.0 | Sharpness MTF 10 line/mm | Sharpness MTF 20 line/mm | Remark |
|---|---|---|---|---|---|
| (1) | 23 | 31 | 0.79 | 0.58 | Comparison |
| (2) | 18 | 23 | 0.92 | 0.66 | Invention |
| (3) | 19 | 24 | 0.91 | 0.65 | Invention |
| (4) | 20 | 24 | 0.87 | 0.63 | Invention |
| (5) | 21 | 25 | 0.85 | 0.62 | Invention |
| (6) | 19 | 23 | 0.91 | 0.65 | Invention |
| (7) | 19 | 23 | 0.90 | 0.64 | Invention |
| (8) | 18 | 22 | 0.89 | 0.63 | Invention |
| (9) | 19 | 25 | 0.91 | 0.65 | Invention |
| (10) | 21 | 26 | 0.88 | 0.63 | Invention |
| (11) | 20 | 25 | 0.89 | 0.63 | Invention |
| (12) | 19 | 24 | 0.91 | 0.64 | Invention |
| (13) | 21 | 26 | 0.85 | 0.62 | Invention |
| (14) | 20 | 25 | 0.90 | 0.65 | Invention |
| (15) | 20 | 25 | 0.87 | 0.63 | Invention |
| (16) | 20 | 26 | 0.89 | 0.63 | Invention |
| (17) | 20 | 25 | 0.88 | 0.62 | Invention |
| (18) | 20 | 24 | 0.91 | 0.65 | Invention |
| (19) | 18 | 24 | 0.91 | 0.64 | Invention |
| (20) | 19 | 25 | 0.89 | 0.62 | Invention |
| (21) | 19 | 24 | 0.90 | 0.63 | Invention |
| (22) | 19 | 25 | 0.89 | 0.62 | Invention |
| (23) | 22 | 31 | 0.82 | 0.53 | Comparison |
| (24) | 23 | 30 | 0.79 | 0.57 | Comparison |
| (25) | 24 | 31 | 0.81 | 0.58 | Comparison |
| (26) | 22 | 29 | 0.83 | 0.60 | Comparison |

*Values obtained by multiplying the R.M.S. data by 1,000

Samples (2) to (22) in which the compounds of the present invention were used were greatly improved in both granularity and sharpness.

Photographic Processing:

| Step | Time (min) | Temperature |
|---|---|---|
| First Development | 6 | 38° C. (±0.3) |
| Washing | 2 | 38° C. (±0.3) |
| Reversal | 2 | 38° C. (±0.3) |
| Color Development | 6 | 38° C. (±0.3) |
| Compensation | 2 | 38° C. (±0.3) |
| Bleaching | 6 | 38° C. (±0.3) |
| Fixing | 4 | 38° C. (±0.3) |
| Washing | 4 | 38° C. (±0.3) |
| Stabilizing | 1 | room temperature |
| Drying | | |

-continued

Photographic Processing:

| | |
|---|---|
| **First Development** | |
| Water | 700 ml |
| Sodium Tetrapolyphosphate | 2 g |
| Sodium Sulfite | 20 g |
| Hydroquinone Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1000 ml |
| **Reversal** | |
| Water | 700 ml |
| Hexasodium Nitrilo-N,N,N—trimethylene-phosphonate | 3 g |
| Stannous Chloride (dihydrate) | 1 g |
| p-Aminophenol | 0.1 g |
| Sodium Hydroxide | 8 g |
| Glacial Acetic Acid | 15 ml |
| Water to make | 1000 ml |
| **Color Development** | |
| Water | 700 ml |
| Sodium Tetrapolyphosphate | 2 g |
| Sodium Sulfite | 7 g |
| Sodium Tertiary Phosphate (dihydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N—Ethyl-N—(β-methanesulfonamidoethyl)-3-methyl-4-aminoaniline Sulfate | 11 g |
| Ethylenediamine | 3 g |
| Water to make | 1000 ml |
| **Compensation** | |
| Water | 700 ml |
| Sodium Sulfite | 12 g |
| Sodium Ethylenediaminetetraacetate (dihydrate) | 8 g |
| Thioglycerine | 0.4 ml |
| Glacial Acetic Acid | 3 ml |
| Water to make | 1000 ml |
| **Bleaching** | |
| Water | 800 ml |
| Sodium Ethylenediaminetetraacetate (dihydrate) | 2.0 g |
| Ammonium Ethylenediaminetetraacetatoferrate(II) (dihydrate) | 120.0 g |
| Potassium Bromide | 100.0 g |
| Water to make | 1000 ml |
| **Fixing** | |
| Water | 800 ml |
| Ammonium Thiosulfate | 80.0 g |
| Sodium Sulfite | 5.0 g |
| Sodium Hydrogen Sulfite | 5.0 g |
| Water to make | 1000 ml |
| **Stabilizing** | |
| Water | 800 ml |
| Formaldehyde (37 wt % aq. soln.) | 5.0 ml |
| Fuji Dri Wel (surface active agent soln.) | 5.0 ml |
| Water to make | 1000 ml |

EXAMPLE 2

On a transparent cellulose triacetate film support, were coated the layers described below in the order listed to prepare a multilayer color photosensitive material (101).

(1) Antihalation layer containing 0.15 g/m$^2$ of black colloidal silver, 0.08 g/m$^2$ of Ultraviolet Absorbent U-1, 0.12 g/m$^2$ of Ultraviolet Absorbent U-2, and gelatin.

(2) Interlayer containing 0.18 g/m$^2$ of 2,5-di-t-pentadecylhydroquinone, 0.11 g/m$^2$ of Coupler C-1, and gelatin.

(3) First red-sensitive emulsion layer containing 1.2 g/m$^2$ of a silver iodobromide emulsion (having a silver iodide content of 4 mol% and a mean grain size of 0.4 micron), $1.4\times10^{-4}$ mol/mol silver of Sensitizing Dye I, $0.4\times10^{-4}$ mol/mol silver of Sensitizing Dye II, $5.6\times10^{-4}$ mol/mol silver of Sensitizing Dye III, $4.0\times10^{-4}$ mol/mol silver of Sensitizing Dye IV, 0.45 g/m$^2$ of Coupler C-2, 0.035 g/m$^2$ of Coupler C-3, 0.025 g/m$^2$ of Coupler C-4, and gelatin.

(4) Second red-sensitive emulsion layer containing 1.0 g/m$^2$ of a silver iodobromide emulsion (having a silver iodide content of 8 mol% and a mean grain size of 0.8 micron), $5.2\times10^{-5}$ mol/mol silver of Sensitizing Dye I, $1.5\times10^{-5}$ mol/mol silver of Sensitizing Dye II, $2.1\times10^{-4}$ mol/mol silver of Sensitizing Dye III, $1.5\times10^{-5}$ mol/mol silver of Sensitizing Dye IV, 0.050 g/m$^2$ of Coupler C-2, 0.070 g/m$^2$ of Coupler C-5, 0.035 g/m$^2$ of Coupler C-3, and gelatin.

(5) Interlayer containing 0.08 g/m$^2$ of 2,5-di-t-pentadecylhydroquinone, and gelatin.

(6) First green-sensitive emulsion layer containing 0.80 g/m$^2$ of silver iodobromide (having a silver iodide content of 4 mol% and a mean grain size of 0.4 micron), $4.0\times10^{-4}$ mol/mol silver of Sensitizing Dye V, $3.0\times10^{-5}$ mol/mol silver of Sensitizing Dye VI, $1.0\times10^{-4}$ mol/mol silver of Sensitizing Dye VII, 0.45 g/m$^2$ of Coupler C-6, 0.13 g/m$^2$ of Coupler C-7, 0.02 g/m$^2$ of Coupler C-8, 0.04 g/m$^2$ of Coupler C-4, and gelatin.

(7) Second green-sensitive emulsion layer containing 0.85 g/m$^2$ of silver iodobromide (having a silver iodide content of 8 mol% and a mean grain size of 0.8 micron), $2.7\times10^{-4}$ mol/mol silver of Sensitizing Dye V, $1.8\times10^{-5}$ mol/mol silver of Sensitizing Dye VI, $7.5\times10^{-5}$ mol/mol silver of Sensitizing Dye VII, 0.095 g/m$^2$ of Coupler C-6, 0.015 g/m$^2$ of Coupler C-7, and gelatin.

(8) Yellow filter layer containing 0.08 g/m$^2$ of yellow collidal silver, 0.090 g/m$^2$ of 2,5-di-t-pentadecylhydroquinone, and gelatin.

(9) First Blue-sensitive emulsion layer containing 0.37 g/m$^2$ of a silver iodobromide emulsion (having a silver iodide content of 5 mol% and a mean grain size of 0.3 micron), $4.4\times10^{-4}$ mol/mol silver of Sensitizing Dye VIII, 0.71 g/m$^2$ of Coupler C-9, 0.07 g/m$^2$ of Coupler C-4, and gelatin.

(10) Second blue-sensitive emulsion layer containing 0.55 g/m$^2$ of a silver iodobromide emulsion (having a silver iodide content of 7 mol% and a mean grain size of 0.9 micron), $3.0\times10^{-4}$ mol/mol silver of Sensitizing Dye VIII, 0.23 g/m$^2$ of Coupler C-9, and gelatin.

(11) First protective layer containing 0.14 g/m$^2$ of Ultraviolet Absorbent U-1, 0.22 g/m$^2$ of Ultraviolet Absorbent U-2, and gelatin.

(12) Second protective layer containing 0.25 g/$^2$ of a silver iodobromide emulsion (having a silver iodide content of 2 mol% and a mean grain size of 0.07 micron), 0.10 g/m$^2$ of polymethacrylate particles (having a diameter of 1.5 micron), and gelatin.

Each of the above-described layers contained additionally Gelatin Hardener H-1 and a surface active agent.

Samples (102) to (110) were prepared in the same manner as Sample (101) except that 50 mol% of Coupler C-2 contained in the third layer was replaced by equimolar amounts of the couplers of the present invention, Compounds (13), (14), (27), (32), (51), (52), (56), (62), and (64), respectively.

Each of these samples was exposed to light emitted from a light source for sensitometry through a red filter and then, subjected to the color development processing described below. Separately, optical exposure for conventional R.M.S. granularity measurement was carried out and subsequently, the same color development processing as above was run. The photographic characteristics and the granularities of the thus processed samples were examined through the red filter. In the granularity measurement, an aperture measureing 48 microns in diameter was used. The results obtained are shown in Table 3.

The development processing employed herein had the following steps, and was carried out at a temperature of 38° C.

| | |
|---|---|
| 1. Color Development | 3 min. 15 sec. |
| 2. Bleaching | 6 min. 30 sec. |
| 3. Washing | 3 min. 15 sec. |
| 4. Fixing | 6 min. 30 sec. |
| 5. Washing | 3 min. 15 sec. |
| 6. Stabilizing | 3 min. 15 sec. |

Compositions of the processing solutions used in the above-described steps, respectively, are described below.

| | |
|---|---|
| Color Developing Solution | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—ethyl-N—β-hydroxyethylamino)-2-methylaniline Sulfate | 4.5 g |
| Water to make | 1 l |
| Bleaching Solution | |
| Ammonium Bromide | 160.0 g |
| Aqueous Ammonia (28%) | 25.0 ml |
| Sodium Ethylenediaminetetraacetato-ferrate(III) | 130.0 g |
| Glacial Acetic Acid | 14.0 ml |
| Water to make | 1 l |
| Fixing Solution | |
| Sodium Tetrapolyphosphate | 2.0 g |
| Sodium Sulfite | 4.0 g |
| Ammonium Thiosulfate (70% aq. soln.) | 175.0 ml |
| Sodium Hydrogen Sulfite | 4.6 g |
| Water to make | 1 l |
| Stabilizing Solution | |
| Formaldehyde (37 wt % aq. soln.) | 8.0 ml |
| Water to make | 1 l |

TABLE 3

| Sample | Coupler of Present Invention | Fog | Red Image Relative Sensitivity* | Granularity** |
|---|---|---|---|---|
| 101 (Comparison) | — | 0.14 | 100 | 0.041 |
| 102 | (13) | 0.14 | 99 | 0.034 |
| 103 | (14) | 0.14 | 100 | 0.033 |
| 104 | (27) | 0.14 | 103 | 0.035 |
| 105 | (32) | 0.14 | 98 | 0.034 |
| 106 | (51) | 0.14 | 96 | 0.035 |
| 107 | (52) | 0.14 | 98 | 0.038 |
| 108 | (56) | 0.14 | 100 | 0.040 |
| 109 | (62) | 0.14 | 98 | 0.037 |
| 110 | (64) | 0.14 | 100 | 0.038 |

*Relative Sensitivity: Standard point of the optical density to determine the sensitivity was fog + 0.2, and the standard sensitivity of Sample (101) was set at 100.
**Granularity: Value at a density of 0.8.

Structural formulae of the compounds employed in Example 2 are illustrated below.
Ultraviolet Absorbent U-1
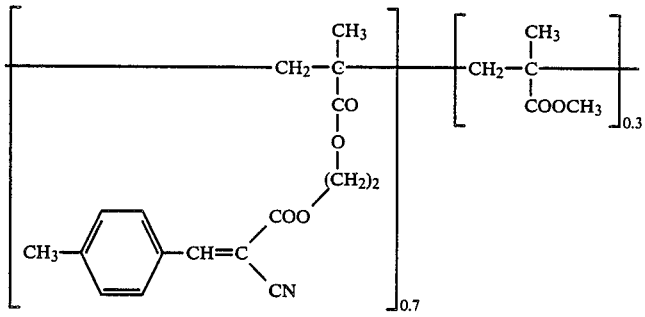
Ultraviolet Absorbent U-2
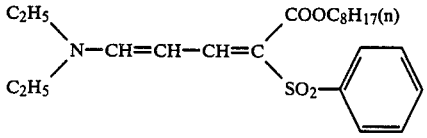
Coupler C-1
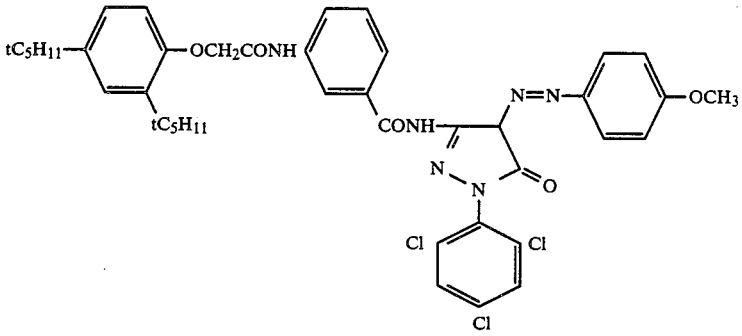
Coupler C-2
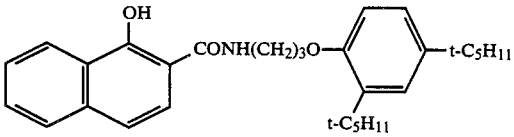
Coupler C-3
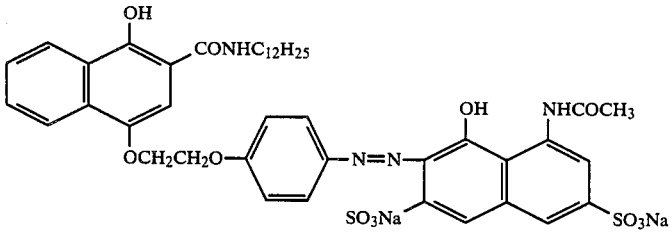
Coupler C-4
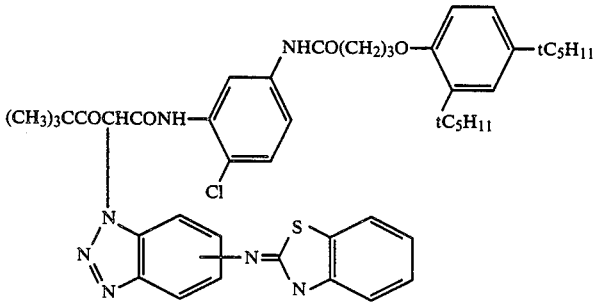

-continued
Coupler C-5
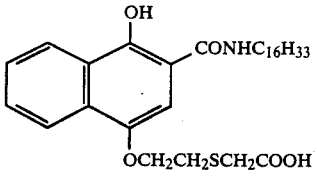
Coupler C-6
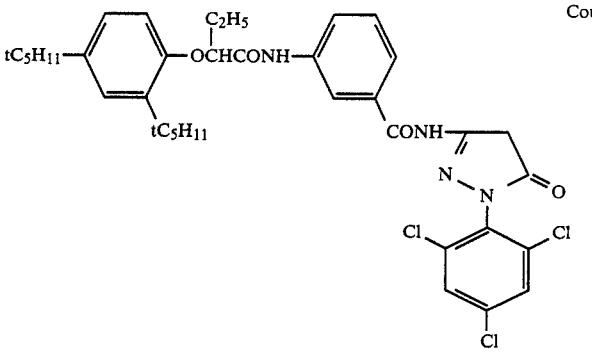
Coupler C-7
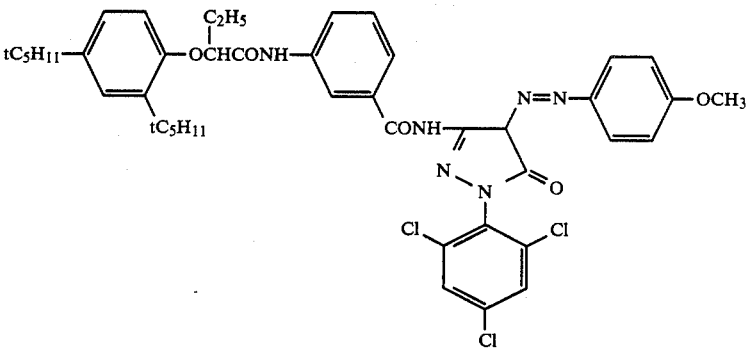
Coupler C-8
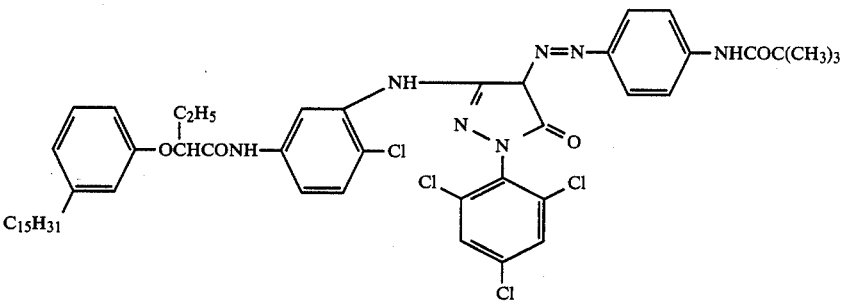
Coupler C-9
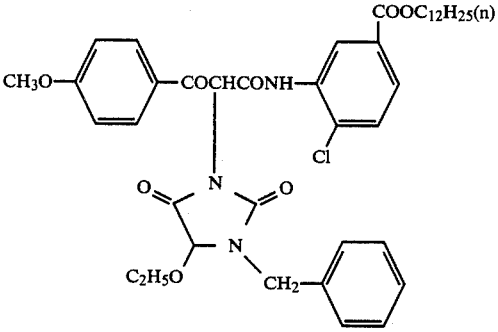
Hardener H-1
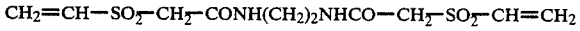
Sensitizing Dye I
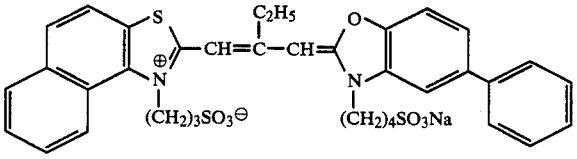
Sensitizing Dye II
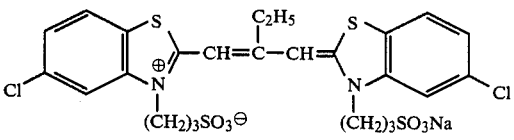
Sensitizing Dye III
Sensitizing Dye IV -continued

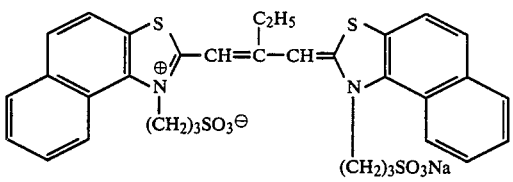

Sensitizing Dye V

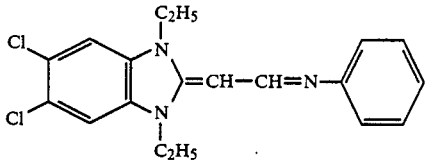

Sensitizing Dye VI

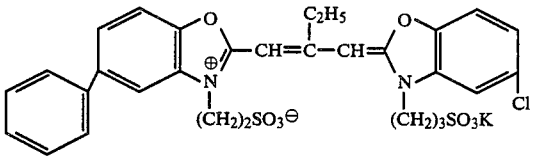

Sensitizing Dye VII

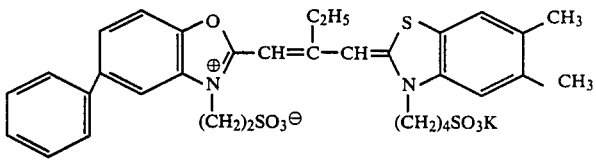

Sensitizing Dye VIII

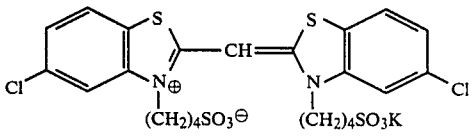

While the invention has been described in detail and with reference to specific embodiment thereof, it will be apparent to one skilled in the art that various changes and modifications can be made therein without departing from the spirit and scope thereof.

What is claimed is:

1. A silver halide color photographic material comprising at least one coupler represented by formulae (Ia), (Ib), or (Ic)

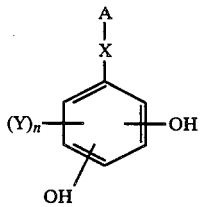

(Ia)

wherein said two —OH groups are at the 2- and 4-positions, the 2- and 3-positions or the 3- and 4-positions with respect to X,

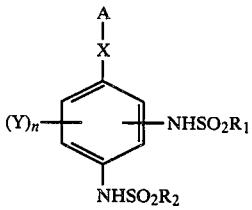

(Ib)

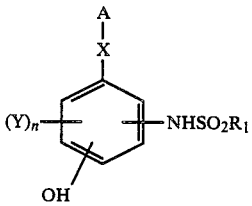

(Ic)

wherein said —OH and —$NHSO_2R_1$ are at the 2- and 4-positions, the 4- and 2-positions, the 3- and 4-positions or the 4- and 3-positions, respectively, with respect to X; wherein A represents a coupler residue which can split away from the coupler by A—X bond cleavage upon reaction with an oxidation product of a developing agent; X represents an oxygen atom or sulfur atom; $R_1$ and $R_2$ each represents an aliphatic group, an aromatic group, or a heterocyclic group; Y represents an aliphatic group, an aromatic group, a heterocyclic group, a halogen atom, an alkoxy group, an aryloxy group, an arylthio group, an alkoxycarbonyl group, a thioureido group, an acylamino group, a sulfonamido group, a cyano group, a nitro group, a carbamoyl group, a sulfamoyl group, an acyloxy group, an alkylthio group, an amino group, a sulfonyl group, a ureido group, an aryloxycarbonyl group, an alkoxycarbonylamino group, a sulfamoylamino group or an acyl group; and n represents 0, 1, or 2, and when n is 2, the two Y's represent the same or different substituent groups, or two of substituents $R_1$, $R_2$ and Y represent divalent groups that combine with each other to form a ring structure.

2. A silver halide color photograph material as claimed in claim 1, wherein Y represents an alkoxy group, an arylthio group, an alkoxycarbonyl group, an alkylthio group, an aryloxycarbonyl group or an alkoxycarbonylamino group.

3. A silver halide color photographic material as in claim 1, wherein said material comprises at least one coupler other than the at least one coupler represented by formulae (Ia), (Ib), or (Ic).

4. A silver halide color photographic material as in claim 1, wherein said aliphatic group for $R_1$ and $R_2$ contains from 1 to 32 carbon atoms and said aromatic group for $R_1$ and $R_2$ contains from 6 to 10 carbon atoms.

5. A silver halide color photographic material as in claim 1, wherein said heterocyclic group for $R_1$ and $R_2$ is a 5- to 7-membered ring group containing one or more hetero atom selected from the class consisting of a nitrogen atom, sulfur atom, an oxygen atom, and a selenium atom.

6. A silver halide color photographic material as in claim 1, wherein X is an oxygen atom.

7. A silver halide color photographic material as in claim 1, said coupler is represented by formula (Ia) wherein Y represents an aliphatic group, an aromatic group, an alokoxy group, an acylamino group, or a sulfonomido group.

8. A silver halide color photographic material as in claim 1, wherein said coupler is represented by formula (Ib) wherein Y represents an aliphatic group, an aromatic group or an alkoxy group.

9. A silver halide color photographic material as in claim 1, wherein said coupler is represented by formula (Ic) wherein Y represents an aliphatic group, an aromatic group, an alkoxy group, an acylamino group, or a sulfonamido group.

10. A silver halide color photographic material as in claim 3, wherein the coupler represented by formula (Ia) has the two —OH hydroxy groups at 2- and 4-positions with respect to X.

11. A silver halide color photographic material as in claim 1, wherein the coupler represented by formula (Ic) has the —OH group and the $—NHSO_2R_1$ group at the 2- and 4-positions with respect to X.

12. A silver halide color photographic material as in claim 3, wherein said material comprises the coupler represented by formula (Ia) in an amount of from 0.001 to 0.8 mol per mol of said at least one other coupler present in the material.

13. A silver halide color photographic material as in claim 12, wherein said material comprises the coupler represented by formula (Ia) in an amount of from 0.1 to 0.5 mol per mol of said at least one other coupler present in the material.

14. A silver halide color photographic material as in claim 3, wherein said material comprises at least one coupler represented by formula (Ib) or (Ic) in an amount of from $1\times10^{-4}$ to 1 mol per mol of said at least one other coupler in the material.

15. A silver halide color photographic material as in claim 14, wherein said material comprises at least one coupler represented by formula (Ib) or (Ic) in an amount of from 0.05 to 0.5 mol per mol of said at least one other coupler in the material.

16. A silver halide color photographic material as in claim 1, wherein said coupler residue is represented by formula (II), (III), (IV), (V), (VI), (VII) or (VIII):

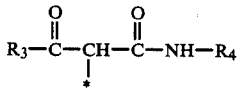
(II)

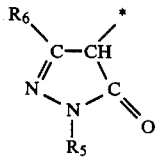
(III)

-continued

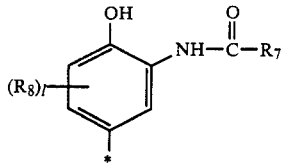
(IV)

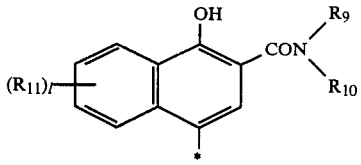
(V)

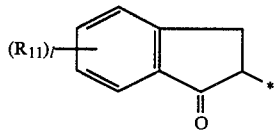
(VI)

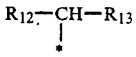
(VII)

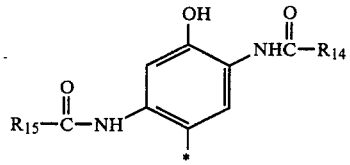
(VIII)

wherein $R_3$ represents an aliphatic group, an aromatic group, an alkoxy group or a heterocyclic group; $R_4$ represents an aromatic group or a heterocyclic group; $R_5$ represents an alkyl group, an alkenyl group, a cycloalkyl group, an aralkyl group, a cycloalkenyl group, an aryl group, a heterocyclic group, an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group; $R_6$ represents a hydrogen atom, an alkyl group, an alkenyl group, a cycloalkyl group, an aralkyl group, a cycloalkenyl group, an aryl group, a heterocyclic group, an alkoxycarbonyl group, an aryloxycarbonyl group, an aralkyloxycarbonyl group, an alkoxyl group, an aryloxy group, an alkylthio group, an arylthio group, a carboxyl group, an acylamino group, a diacylamino group, an N-alkylacylamino group, an N-arylacylamino group, a ureido group, a urethane group, a thiourethane group, an arylamino group, an alkylamino group, a cycloamino group, a heterocyclic amino group, an alkylcarbonyl group, an arylcarbonyl group, a sulfonamido group, a carbamoyl group, a sulfamoyl group, a cyano group or a hydroxyl group; $R_7$ represents an aliphatic group or an aromatic group; $R_8$ represents an aliphatic group, a halogen atom, an alkoxy group or an aromatic group; $R_9$ and $R_{10}$ each represents a hydrogen atom, an aliphatic group or an aromatic group; $R_{11}$ represents a halogen atom, an acylamino group, a sulfonamido group, an alkoxy group or an aliphatic group; $R_{12}$ represents an arylcarbonyl group, an alkanoyl group, an arylcarbamoyl group, an alkanecarbamoyl group, an alkoxycarbonyl group or an aryloxycarbonyl group; $R_{13}$ represents an arylcarbonyl group, an alkanoyl group, an arylcarbamoyl group, an alkanecarbamoyl group, an alkoxycarbonyl group, an aryloxycarbonyl group, an alkanesulfonyl group, an arylsulfonyl group, an aryl group or a 5- or 6-membered heterocyclic group; $R_{14}$ represents an aliphatic group, an aromatic group, a heterocyclic group or an anilino gorup; $R_{15}$ represents an aliphatic group or an aromatic group; l is 0, 1 or 2 and when l is 2 the two $R_8$'s or $R_{11}$'s represent the same or different groups; and said coupler residue bonds to X in formula (Ia), (Ib) or (Ic) at the position indicated by *.

17. A silver halide color photographic material as in claim 1, wherein n is 2 and the group represented by $(Y)_n$ is

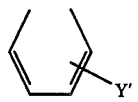

wherein Y' represents a hydrogen atom, an aliphatic group, an aromatic group, a heterocyclic group, a halogen atom, an alkoxy group, an aryloxy group, an arylthio group, an alkoxycarbonyl group, a thioureido group, an acylamino group, a sulfonamido group, a cyano group, a nitro group, a carbamoyl group, a sulfamoyl group, an acyloxy group, an alkylthio group, an amino group, a sulfonyl group, a ureido group, an aryloxycarbonyl group, an alkoxycarbonylamino group, a sulfamoylamino group, or an acyl group.

18. A silver halide color photographic material as in claim 3, wherein said at least one other coupler is a color coupler.

19. A silver halide color photographic material as in claim 18, wherein said at least one other color coupler is a cyan coupler, a magenta coupler or a yellow coupler.

20. A silver halide color photographic material as claimed in claim 1 wherein the coupler used is represented by formula (Ia).

21. A silver halide color photographic material as claimed in claim 1 wherein the coupler used is represented by formula (Ib).

22. A silver halide color photographic material as claimed in claim 1 wherein the coupler used is represented by formula (Ic).

23. A silver halide color photographic material as claimed in claim 1 wherein Y represents an aliphatic group, an aromatic group, a halogen atom, an alkoxy group, an aryloxy group, an arylthio group, an alkoxycarbonyl group, a thioureido group, an acylamino group, a sulfonamido group, a cyano group, a nitro group, a carbamoyl group, a sulfamoyl group, an acyloxy group, an alkylthio group, an amino group, a sulfonyl group, a ureido group, an aryloxycarbonyl group, an alkoxycarbonylamino group, a sulfamoylamino group or an acyl group.

24. A silver halide color photograph material as claimed in claim 23, wherein Y represents an alkoxy group, an arylthio group, an alkoxycarbonyl group, an alkylthio group, an aryloxycarbonyl group or an alkoxycarbonylamino group.

* * * * *